United States Patent [19]

Fujita et al.

[11] Patent Number: 4,855,218

[45] Date of Patent: Aug. 8, 1989

[54] METHOD FOR PROCESSING SILVER HALIDE PHOTOGRAPHIC LIGHTSENSITIVE MATERIALS

[75] Inventors: Yoshihiro Fujita; Akira Abe, both of Minami-Ashigara, Japan

[73] Assignee: Fuji Photo Film Co., Ltd., Minami-Ashigara, Japan

[21] Appl. No.: 154,200

[22] Filed: Feb. 10, 1988

[30] Foreign Application Priority Data

Feb. 13, 1987 [JP] Japan ..... 62-31094
Feb. 13, 1987 [JP] Japan ..... 62-31095

[51] Int. Cl.[4] ..... G03C 5/24; G03C 7/40; G03C 7/00; G03C 5/44

[52] U.S. Cl. ..... 430/428; 430/372; 430/393; 430/401; 430/421; 430/430; 430/467; 430/490; 430/491

[58] Field of Search ..... 430/401, 491, 421, 463, 430/393, 430, 467, 490, 372, 428

[56] References Cited

U.S. PATENT DOCUMENTS

| | | | |
|---|---|---|---|
| 3,647,462 | 3/1972 | Surash et al. | 430/467 |
| 4,336,324 | 1/1982 | Koboshi et al. | 430/372 |
| 4,618,569 | 10/1986 | Kurematsu et al. | 430/428 |
| 4,764,453 | 8/1988 | Koboshi et al. | 430/351 |

OTHER PUBLICATIONS

H. P. Gregor, "Application of Ion Exchange Resins in Photographic Processing", 1951, Phot. Eng., vol. 2, No. 3, pp. 102–109.

J. H. Priesthoff, "Improved Technique for Ion-Exchange Recovery of Eastman Color Developers", 1957, Journal of the SMPTE, vol. 66.

L. E. West, "The Quality of Water for Photographic Processing", Photographic Science & Eng., vol. 3, No. 6, Nov. Dec. 1959, 283–287.

*Primary Examiner*—Mukund J. Shah
*Attorney, Agent, or Firm*—Burns, Doane, Swecker & Mathis

[57] ABSTRACT

A method for processing silver halide photographic lightsensitive material in which there are used replenishers for water washing and/or stabilization processes in such manner that the concentrations of calcium and magnesium compounds present in the replenishers are not more than 5 mg/l on the basis of elemental calcium and magnesium respectively, and a part or whole of the overflow from the water washing and/or stabilization process is introduced into a process preceding the water washing and/or stabilization processes. This method makes it possible to save water, to diminish the amount of waste liquor and to make effective use of components contained in processing solutions, without impairing any properties of lightsensitive materials to be processed.

12 Claims, No Drawings

METHOD FOR PROCESSING SILVER HALIDE PHOTOGRAPHIC LIGHTSENSITIVE MATERIALS

BACKGROUND OF THE INVENTION (1) Field of the Invention

The present invention relates to a method for processing silver halide photographic lightsensitive materials and in particular to a method for processing silver halide photographic materials, which makes it possible to reduce the amount of waste liquor and to make effective use of agents in processing solutions.

(2) Prior Art

It has been proposed to reduce the amount of washing water used in water washing and other processes for processing silver halide photographic lightsensitive materials, in view of environmental protection, exhaustion of water resources and enhanced economy. For example, one of such techniques for reducing the amount of washing water is proposed by S. R. Goldwasser in his article entitled "Water Flow Rates in Immersion-Washing of Motion Picture Film", Journal of the Society of Motion Picture and Television Engineers, 1955, Vol. 64, pp. 248–253 in which saving of the amount of washing water is achieved by employing a multistage washing system including the use of a plurality of washing tanks and countercurrently passing water therethrough. This method has been adopted in different kinds of automatic processors as an effective means for water-saving.

According to this multistage countercurrent system, the amount of water to be supplied can be reduced as the number of water washing baths is increased. However, the increase in the number of water washing baths leads to an increase in the space occupied by the automatic processors and, therefore, the number of water washing or stabilization baths in such a multistage countercurrent system is in general 2 to 6 and in most cases 2 to 4.

Moreover, Japanese Patent Un-examined Publication (hereinafter referred to as J. P. KOKAI) No. 57-8543 discloses a method which makes it possible to stabilize images and to save washing water by processing the lightsensitive material with stabilization baths having stabilization effect under the multistage countercurrent system after the water washing process is carried out under the multistage countercurrent system.

However, this method also suffers from a problem that even if such stabilization baths are used, the number of baths must be increased to achieve water-saving effect. Therefore, this method does not satisfy the requirements in this field.

If washing water is substantially saved without increasing the number of water washing or stabilization baths, this entrains various troubles, for instance, there is a tendency of causing adhesion between processed lightsensitve materials and the discolorlation of images becomes extremely high due to the increase in the concentration of components contained in the preceding bath, such as a fixing or bleaching-fixing bath components, in the washing or stabilization solution. In order to eliminate such troubles, J. P. KOKAI Nos. 58-105150 and 60-241053 disclose methods in which an apparatus for reverse osmosis is employed as a means for water-saving without increasing the number of water washing or stabilization baths.

In these methods, the overflow from water washing or stabilization baths is directly transferred to such an apparatus for reverse osmosis and the liquid passed therethrough is supplied to water washing or stabilization baths, while the concentrated liquid which remains therein is fed to a bleaching-fixing bath or an apparatus for recovering silver. However, this method is practically carried out without using a large apparatus provided with a pump capable of applying a high pressure to a membrane for reverse osmosis, having a large area. It is therefore quite difficult to sufficiently reduce the amount of liquid concentrated and discharged from the reverse osmosis apparatus (hereunder referred to as the concentrated solution) with respect to the amount of clean solution passing through the membrane for reverse osmosis (hereinafter referred to as the membrane-permeated solution). Using the large apparatus requires a huge initial investment.

On the other hand, J. P. KOKAI No. 60-235133 describes a method in which the overflow from water washing and stabilization process is used in the preceding bath having fixing ability for the purposes of saving water and reducing the overall waste liquor.

This method can serve to lower the production cost since the components of the preceding bath carried over to the stabilization process by the lightsensitive material in the absorbed state can be recycled.

However, if this method is carried out using an automatic processor for a long period of time, conveyor rollers, squeeze blades or the like of the automatic processor at the portions corresponding to baths having fixing ability and the following stabilization baths are extremely stained and collect deposits thereon. This results in various troubles such as the contamination of lightsensitive materials and the formation of defects thereon.

Commonly, it is necessary to add to the stabilization bath such an antibacterial or antifungus agents as 5-chloro-2-methyl-4-isothiazolin-3-one and such a chelating agent as 1-hydroxyethylidene-1,1-diphosphonic acid. However, the use of these additives is often accompanied by the aforementioned troubles and may possibly impair the quality of the preceding bath. On the contrary, if the overflow from a water washing process in which city water is used and saved is introduced into the preceding bath, a severe problem is caused. Specifically, bacteria and/or mold severely proliferate in each bath for water washing process and adhere to the lightsensitive material pass therethrough. Moreover, the conveyor rollers, squeeze blades and the like are contaminated and collect deposits, while bacteria and mold proliferate thereon simultaneously. Thus, the commercial value of the processed lightsensitive material is extremely lowered. Therefore these methods cannot be adopted practically.

As explained above, it is important to introduce the overflow from water washing and/or stabilization processes into the preceding bath in view of water-saving, reduction of the amount of waste liquor and effective use of the components of processing solutions. Nevertheless, such processes have not yet been effected practically because of the aforementioned problems.

SUMMARY OF THE INVENTION

Accordingly, it is a primary object of the present invention to provide a method for processing silver halide photographic lightsensitive materials, which permits water-saving, reduction in the amount of waste liquor and effective use of components of processing solutions without impairing the properties of the lightsensitive materials processed.

Another object of the present invention is to provide a method for processing silver halide photographic lightsensitive materials, which makes it possible to introduce the overflow from water washing and/or stabilization processes into a bath preceding the processes, without exerting any influence on the properties of the preceding bath.

Another object of the present invention is to provide a method for processing silver halide photographic lightsensitive materials, which can reduce the amount of maintenance required by automatic processors.

The aforementioned objects of the present invention can effectively be accomplished by providing a method for processing silver halide photographic materials in which the concentrations of calcium and magnesium compounds in replenishers for water washing and/or stabilization processes are reduced to not more than 5 mg/l on the basis of elemental calcium and magnesium, respectively, and in which a part or whole of the overflow from the water washing and/or the stabilization processes is introduced into a process preceding the water washing and/or the stabilization processes.

The term "water washing (process)" herein means a process for ensuring the desired properties of the processed lightsensitive materials by washing out the components of the treating liquid (or solution) which are attached to or absorbed by the lightsensitive material and the ingredients of the lightsensitive materials which become useless during the treatment.

On the other hand, the term "stabilization (process)" herein means a process for enhancing the storability of images to a level which is not attainable by simply carrying out the aforementioned water washing process and which uses a stabilization solution containing components having an imagestabilization effect.

The term "the amount of liquid (or solution) carried over" herein used is defined as the volume of the liquid which is attached to or absorbed and carried over by the processed lightsensitive material from the preceding bath to the water washing or the stabilization process, for instance, the amount carried over from the fixing solution containing a thiosulfate, and which may be determined in accordance with the following method:

METHOD FOR DETERMINING THE AMOUNT CARRIED OVER

A sample of 1 m long is collected just before the lightsensitive material, during treating, enter into a water washing bath or a stabilization bath and immediately thereafter the sample is immersed in 1 liter of distilled water followed by maintaining it at 30° C. while stirring with a magnetic stirrer for 10 minutes. Then, a volume of liquid is taken therefrom, quantitatively analyzed on the concentration of thiosulfate ions $C_1$ (g/l) contained therein. At the same time the concentration of thiosulfate ions $C_2$ (g/l) of the fixing liquid in the preceding bath is also quantitatively determined and thus the amount of liquid A (ml) carried over from the preceding bath is estimated according to the following relation:

$$C_1 \times \frac{(1000 + A)}{A} = C_2$$

In this connection, the quantitative determination of the thiosulfate ions is effected according to acidic iodine titration after adding formaldehyde to the sample in order to mask the coexisting sulfite ions.

DESCRIPTION OF THE PREFERRED EMBODIMENTS

The water washing process and the stabilization process in the present invention will now be explained in more detail. The amount of processing solutions to be replenished to the water washing process or the stabilization process is in the range of from 1 to 50 times the volume of the solution carried over by the lightsensitive material treated per unit area thereof from the preceding bath, preferably 2 to 30 times the volume thereof and more preferably 3 to 20 times. The washing water or the stabilization solution may be replenished either continuously or intermittently during processing. When the replenishment is conducted intermittently, the prescribed amount of the washing water or the stabilization solution may be added to the water washing bath or the stabilization bath at intervals of about 1 $m^2$ or less, preferably 0.001 to 0.5 $m^2$ of the photosensitive material processed. Further, in the case where the amount of the photosensitive material processed is small, the prescribed amount of the washing water or the stabilization solution may be replenished after the completion of the process.

The inventors of this invention have unexpectedly found that all of the aforementioned problems associated with the introduction of overflow from the water washing and/or the stabilization processes into the preceding bath can effectively be solved by previously reducing the concentrations of calcium and magnesium contained in replenishers for the water washing and/or the stabilization processes to not more than 5 mg/l.

In other words, the control of the amount of calcium and magnesium in the replenishers necessarily results in the reduction thereof in the water washing baths and the stabilization baths. For this reason, the proliferation of bacteria and mold therein is suppressed without using antibacterial or antifungus agents and the problems of the contamination of conveyor rollers, squeeze blades of an automatic processor and the formation of deposits thereon are simultaneously solved.

Accordingly to a preferred embodiment of the present invention, the concentrations of calcium and magnesium compounds present in a replenisher for at least one process disposed just before the water washing and/or stabilization processes, among the processes preceding the water washing and/or stabilization processes, is also controlled to not more than 5 mg/l, preferably not more than 3 mg/l, on the basis of elemental calcium and magnesium respectively.

In the method of this invention, the concentration of calcium and magnesium in the replenishers for water washing and/or stabilization processes as well as for the preceding processes are reduced to 5 mg/l or less expressed as elemental calcium and magnesium respectively, as already mentioned above. It is particularly preferred to control the concentration of calcium and magnesium in the replenishers to not more than 3 mg/l and most preferably 1 mg/l or less.

The control of the amount of magnesium and calcium compounds in each replenisher may be accomplished by any known method. Preferred examples thereof are an ion exchange technique and an reverse osmosis technique.

In the ion exchange technique, various cation exchange resins can be used herein. Preferred examples thereof are those of Na-type capable of exchanging Ca, Mg with Na. In addition, H-type cationic ion exchange resins can also be used. However, in this case, it is preferable to use the resin together with an OH-type anion exchange resin since the pH of the processed water becomes acidic when H-type one is used alone.

In this respect, preferred ion exchange resins are strong acidic cation exchange resins which are mainly composed of styrene-divinylbenzene copolymer and have sulfonic groups as the ion exchange group. Examples of such ion exchange resins include Diaion SK-1B or Diaion PK-216 (manufactured and sold by MITSUBISHI CHEMICAL INDUSTRIES LTD.). The basic copolymer of these ion exchange resins preferably comprises 4 to 16% by weight of divinylbenzene on the basis of the total charge weight of monomers at the time of preparation. Moreover, preferred examples of anion exchange resins which may be used in combination with H-type cation exchange resins are strong basic anion exchange resins which mainly comprise styrene-divinylbenzene copolymer and have tertiary amino or quaternary ammonium groups as the ion exchange group. Specific examples thereof include Diaion SA-10A or Diaion PA-418 (also, maufactured and sold by MITSUBISHI CHEMICAL INDUSTRIES LTD.).

As to the apparatus for reverse osmosis, any known ones may be used in the method of this invention without any restriction. However, it is desirable in the present invention to use a highly compact apparatus for reverse osmosis. The use of such a highly compact apparatus results in good workability and sufficient water-saving effect. In addition, the replenishers for water washing and/or stabilization processes to be treated may be passed through a layer of active carbon or a magnetic field.

The membrane for reverse osmosis fitted to the apparatus therefor includes, for instance, membrane of cellulose acetate, membrane of ethyl cellulose-polyacrylic acid, membrane of polyacrylonitrile, membrane of polyvinylene carbonate and membrane of polyether sulfone.

The pressure for passing liquid through the membrane usually falls within the range of from 5 to 60 $kg/cm^2$. However, it is sufficient to use a present of not more than 30 $kg/cm^2$ in order to achieve the purposes of the present invention and a so-called low-pressure reverse osmosis apparatus driven at a pressure of 10 $kg/cm^2$ or less may also be used in the invention effectively.

The structure of the membrane for reverse osmosis may be spiral, tubular, hollow fiber, pleated or rod type one.

Furthermore, it is preferred to irradiate, with ultraviolet rays, the solution included in at least one bath selected from water washing baths and stabilization baths inclusive of auxiliary tanks therefor, which permits the more effective suppression of proliferation of mold.

The source of ultraviolet light as used herein may be an ultraviolet lamp such as a low pressure mercury vapour discharge tube which emits line spectrum of 253.7 nm in wavelength. In the present invention, preferred are those having a power of bactericidal ray ranging from 0.5 W to 7.5 W, among others.

The ultraviolet lamp may be disposed either outside or inside the solution to be irradiated.

According to the method of this invention, an antibacterial agent or antifungus agent is not necessarily used. However, they may be used in the method of this invention, if desired, so far as they exert no influence on the properties of the preceding bath.

Examples of such antibacterial or antifungus agents include isothiazolone type antibacterial agents such as 5-chloro-2-methyl-4-isothiazolin-3-one and 2-methyl-4-isothiazolin-3-one; benzoisothiazoline type antibacterial agents such as 1,2-benzoisothiazolin-3-one; triazole derivatives as such benzotriazole; a sulfamide type antibacterial agent such as sulfanylamide; an active-halogen releasing compound such as sodium hypochlorite or sodium dichloroisocyanurate; a phenol type antifungus agent such as o-phenylphenol; and an organic arsenic type antifungus agent such as 10,10'-oxybisphenoxy arsine.

Moreover, it is also possible to add, as a softener for hard water, an aminopolycarboxylic acid such as ethylenediaminetetraacetic acid, diethylenetriaminepentaacetic acid or cyclohexanediaminetetraacetic acid; a phosphonic acid or an aminophosphonic acid such as 1-hydroxyethylidene-1,1-diphosphonic acid or ethylenediaminetetramethylene phosphonic acid. These chelating agents are preferably used in the form of a sodium salt, a potassium salt or an ammonium salt.

In the stabilization solution, there are used compounds having image stabilization effect in addition to those used in the water washing process. Typical examples thereof include an aldehyde compound such as formaldehyde (formalin) or glutaraldehyde. In this respect, it is not necessary to add an aldehyde compound such as formalin to the stabilization solution if the color lightsensitive materials include a 2-equivalent magenta coupler.

In addition to the aforementioned compounds, the stabilization solution may include other various compounds, for instance, a variety of buffering agents for adjusting the pH of the processed film of lightsensitive material, such as borates, metaborates, borax, phosphates, carbonates, potassium hydroxide, sodium hydroxide, aqueous ammonia, monocarboxylic acids, dicarboxylic acids and polycarboxylic acids which are used in a proper combination. Moreover, there may be added thereto a fluorescent brightener and a variety of ammonium salts such as ammonium chloride, ammonium sulfite, ammonium sulfate and ammonium thiosulfate.

In the present invention, it is possible to more effectively prevent the lightsensitive materials after processing from lowering their adhesion properties by incorporating an ammonium compound into the washing water and/or the stabilization solution. Such an ammonium compound may be any organic or inorganic ones and specific examples thereof include ammonium hydroxide, ammonium sulfate, ammonium chloride, ammonium nitrate, ammonium bromide, ammonium acetate, ammonium iodide, ammonium propionate, ammonium carbonate, ammonium citrate, ammonium bicarbonate, ammonium tartrate, ammonium hydrogen phosphate, ammonium formate, ammonium phosphate, ammonium succinate, ammonium benzoate, ammonium lactate, ammonium phthalate, ammonium oxalate, and ammonium sulfite.

Moreover, it is also effective to use ammonium salt of any chelating agents such as aminopolycarboxylic acids, and aminopolyphosphonic acids. Among these, preferred examples of chelating agents include ethylenediamine-di-o-hydroxyphenylacetic acid, nitrilotriacetic acid, hydroxyethylenediaminetriacetic acid, diethylenetriaminepentaacetic acid, hydroxyethyliminodiacetic acid, diaminopropanoltetraacetic acid, transcyclohexanediaminetetraacetic acid, N,N,N',N'-ethylenediaminetetramethylene phosphonic acid, nitrilotrimethylene phosphonic acid, 1-hydroxyethylidene-1,1'-diphosphonic acid, 1,1'-diphosphonoethane-2-carboxylic acid, 2-phosphonobutane-1,2,4-tricarboxylic acid, 1-hydroxy-1-phosphonopropane-1,2,3-tricarboxylic acid, sodium catechol-3,5-disulfonate pyrophosphate, sodium tetrapolyphosphate, sodium hexanemetaphosphate and ethylenediaminetetraacetic acid.

Particularly prefered ammonium compounds are ammonium sulfate, ammonium chloride and ammonium sulfite.

These ammonium compounds are added to the stabilization solution in an amount of from $1\times10^{-3}$ to 0.5 moles/l, preferably from 0.05 to 0.1 mole/l.

The pH value of the washing water or the stabilization solution usually range from 4 to 9 and preferably 5 to 8. However, the stabilization solution may sometimes be used in an acidic condition (pH of not more than 4) by the addition of an acid such as acetic acid according to the applications and purposes.

The time required for the water washing or the stabilization process will now be explained hereinafter.

In the method according to the present invention, the water washing process or the stabilization process is in general effected for 10 seconds to 10 minutes. However, in view of quick treatment, it is preferred to shorten the time required for these treatments as short as possible, more specifically to reduce the time to 20 seconds to 4 minutes, in particular to 20 seconds to 2 minutes.

It is preferable to carry out the water washing process or the stabilization process in combination with various means for promoting the washing effect. Examples of such a means which may be used in the present invention include a means for generating ultrasonics in the liquid, a means for air bubbling, a means for applying a jet stream to the surface of the lightsensitive materials and a pair of rollers for compressing the lightsensitive material processed.

The water washing process or the stabilization process may be effected at a temperature ranging from 20° to 50° C., preferably 25° to 45° C. and more preferably 30° to 40° C.

In the present invention, the water washing and/or the stabilization processes can comprise a single bath or a plurality of baths. However, these processes preferably comprise a plurality of baths not less than 2, in particular 2 to 4 baths from the viewpoint of water-saving. When the processes comprise a plurality of baths, the replenishment is preferably effected in accordance with multistage countercurrent system in which the replenisher therefor is supplied to the last bath and the overflow thereof is, in order, transferred to the preceding bath.

The term "the overflow from the water washing and/or the stabilization processes" herein means the liquid which flows over out of the baths in consequence of the addition of the replenisher. This overflow may be introduced into a bath of the preceding process. For instance, the overflow can be introduced into the bath through a slit formed on the upper portion of the wall disposed between these baths of an automatic developer or it may once be stored in a proper reservoir outside of the automatic developer and then supplied thereto using a pumping means.

This makes it possible to properly maintain a desired concentration of the solution for the preceding process by simply adding a more concentrated replenisher therefor to the bath in a small amount and as a result, the amount of waste liquor therefrom can substantially be reduced.

The same effect can of course be achieved by storing the overflow in a tank for preparing a solution and adding thereto components of the replenisher required to prepare the latter.

In this respect, the overflow includes the components of the preceding bath, which are carried over by the processed lightsensitive material therefrom. Therefore, the use of the overflow makes it possible to redcue the overall amount of the components to be replenished to the preceding bath, to lower the degree of environmental pollution and to reduce the processing cost.

The amount of the overflow to be introduced into the preceding bath may be determined arbitrarily so as to be suitable for controlling the concentration of the preceding bath. However, it is generally determined so that the ratio of the replenished amount of the water washing or the stabilization bath to that of the preceding bath equals to 0.2 to 5, preferably 0.3 to 3 and particularly 0.5 to 2.

The method of the present invention can be applied to any processing methods irrespective of the kind of the bath preceding the water washing or stabilization bath. However, the preceding bath is preferably a bath having fixing ability. The bath having fixing ability can be a simple fixing bath or a bleaching-fixing bath.

The processes for silver halide color photographic materials to which the method according to the present invention can be applied are, for instance, as follows. However, it is not intended to restrict the scope of this invention to such specific examples at all:

1. color development—bleaching—(water washing-)—fixing—(water washing)—(stabilization);
2. color development—bleaching and fixing—(water washing)—(stabilization);
3. color development—bleaching—bleaching and fixing—(water washing)—(stabilization);
4. color development—bleaching—bleaching and fixing—fixing—(water washing)—(stabilization);
5. color development—bleaching—fixing—bleaching and fixing—(water washing)—(stabilization);
6. monochromatic development—water washing—(-reversing)—color development—(conditioning)—bleaching—fixing—(water washing)—(stabilization);
7. monochromatic development—water washing—(-reversing)—color development—(conditioning)—-bleaching and fixing—(water washing)—(stabilization);
8. monochromatic development—water washing (reversing)—color development—(conditioning)—-bleaching—bleaching and fixing—water washing;
9. monochromatic development—fixing—water washing;
10. monochromatic development—fixing—stabilization.

In the foregoing processes, the steps in the parenthesis may be omitted in accordance with the kinds, the purposes and the applications of the lightsensitive materials, however, the water washing and the stabilization processes can not simultaneously be omitted.

Each of the processing baths will now be explained below.

Color Developing Solution

A color developing solution used in the method of the present invention is preferably an aqueous alkaline solution containing an aromatic primary amine type color developing agent as a main component. Although, aminophenolic compounds are also useful as such a color developing agent, p-phenylenediamine type compounds are preferred.

Examples of the latter compounds include 3-methyl-4-amino-N,N-diethylaniline, 3-methyl-4-amino-N-ethyl-N-beta-hydroxyethylaniline, 3-methyl-4-amino-N-ethyl-N-beta-methanesulfonamidoethylaniline, 3-methyl-4-amino-N-ethyl-N-beta-methoxyethylaniline; or sulfate, hydrochloride, phosphate, p-toluenesulfonate, tetraphenylborate and p-(tertoctyl)-benzenesulfonate thereof. These diamines are generally more stable in a salt state than in a free state and, therefore, the salts are preferably used.

Examples of the aminophenol type derivatives are o-aminophenol, p-aminophenol, 4-amino-2-methylphenol, 2-amino-3-methylphenol and 2-oxy-3-amino-1,4-dimethylbenzene.

In addition, it is also possible to use those disclosed in L. F. A. Mason, "Photographic Processing Chemistry", Focal Press (1966), p. 226 to 229; U.S. Pat. Nos. 2,193,015 and 2,592,364; and J. P. KOKAI No. 48-64933. These color developing agents can be used in combination, if desired.

A color developing solution generally contains a pH buffering agent such as carbonates, borates or phosphates of alkali metals; a development inhibitor or an antifoggant such as bromides, iodides, benzimidazoles, benzothiazoles or mercapto compounds; a preservative such as hydroxylamine, diethylhydroxylamine, triethanolamine, catechol sulfonic acid, 1,4-diazabicyclo(2,2,-7)octane, phenyl semicarbazide acid, hydrazines, compounds disclosed in OLS No. 2,622,950, sulfites or bisulfites; an organic solvent such as diethylene glycol; a development accelerator such as benzyl alcohol, polyethylene glycol, quaternary ammonium salts, amines, thiocyanates or 3,6-thiaoctane-1,8-diol; a dye-forming coupler; a competing coupler; a nucleus forming agent such as sodium borohydride; an auxiliary developing agent such as 1-phenyl-3-pyrazolidone; a thickener; and a chelating agent such as ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, aminopolycarboxylic acid as described in J. P. KOKAI No. 58-195845, 1-hydroxyethylidene-1,1'-diphosphonic acid, organic phosphonic acids as described in Research Disclosure No. 18170 (May, 1979), aminophosphonic acids such as aminotris(methylenephosphonic acid) and ethylenediamine-N,N,N',N'-tetramethylenephosphonic acid, and phosphonocarboxylic acids as described in J. P. KOKAI Nos. 52-102726, 53-42730, 54-121127, 55-4024, 55-4025, 55-126241, 55-65955 and 55-65956, and Research Disclosure No. 18170 (May, 1979).

The color developing agent is generally used in an amount of about 0.1 to about 30 g, preferably about 1 to 15 g per liter of a color developing solution. The pH value of the color developing solution is generally 7 or higher and most generally about 9 to about 13. Further, it is possible to use an auxiliary solution, in which the concentrations of halides, a color developing agent and the like are adjusted, so as to decrease the amount of the replenisher for the color developing bath. In an example of such a treatment employing a small amount of the replenisher, an auxiliary solution having a bromide concentration of not more than $4\times10^{-3}$ moles/l is replenished to the color developing bath in an amount of not more than 9 ml per 100 $cm^2$ of the processed lightsensitive materials.

Color developing is preferably conducted at a temperature of 20° to 50° C., more preferably 30° to 40° C. and for preferably 20 seconds to 10 minutes, more preferably 30 seconds to 5 minutes.

Bleaching, Bleaching and Fixing, and Fixing Solutions

The photographic emulsion layer, after the color development, is usually subjected to a bleaching process. The bleaching may be carried out at the same time with a fixing treatment, as called bleaching and fixig, or may be carried out separately.

An example of bleaching agent used in the bleaching solution or the bleaching and fixing solution in the present invention is a ferric ion complex which is a complex of ferric ion with a chelating agent such as aminopolycarboxylic acid, aminopolyphosphonic acid or a salt thereof. The aminopolycarboxylic acid salts or the aminopolyphosphonic acid salts are an alkali metal salt, ammonium salt or water-soluble amine salt of aminopolycarboxylic acid or aminopolyphosphonic acid. The alkali metal is, for instance, sodium, potassium and lithium and examples of water-soluble amines are alkyl amines such as methylamine, diethylamine, triethylamine and butylamine; alicyclic amines such as cyclohexylamine; arylamines such as aniline and m-toluidine; and heterocyclic amines such as pyridine, morpholine and piperidine.

Typical examples of the chelating agents such as aminopolycarboxylic acid, aminopolyphosphonic acid and salts thereof are as follows, however, it should be appreciated that the scope of the present invention is not limited to the following specific examples:

Ethylenediaminetetraacetic acid;
Disodium ethylenediaminetetraacetate;
Diammonium ethylenediaminetetraacetate;
Tetra(trimethylammonium) ethylenediaminetetraacetate;
Tetrapotassium ethylenediaminetetraacetate;
Tetrasodium ethylenediaminetetraacetate;
Trisodium ethylenediaminetetraacetate;
Diethylenetriaminepentaacetic acid;
Pentasodium diethylenetriaminepentaacetate;
Ethylenediamine-N-(beta-oxyethyl)-N,N',N'-triacetic acid;
Trisodium ethylenediamine-N-(beta-oxyethyl)-N,N',N'-triacetate;
Triammonium ethylenediamine-n-(beta-oxyethyl)-N,N',N'-triacetate;
1,2-Diaminopropanetetraacetic acid;
Disodium 1,2-diaminopropanetetraacetate;
1,3-Diaminopropanetetraacetic acid;
Diammonium 1,3-diaminopropanetetraacetate;
Nitrilotriacetic acid;
Trisodium nitrilotriacetate;
Cyclohexanediaminetetraacetic acid;
Disodium cyclohexanediaminetetraacetate;
Iminodiacetic acid;
Dihydroxyethyl glycine;
Ethyl ether diaminetetraacetic acid;
Glycol ether diaminetetraacetic acid;
Ethylenediaminetetrapropionic acid;

Phenylenediaminetetraacetic acid;
1,3-Diaminopropanol-N,N,N',N'-tetramethylene phosphonic acid;
Ethylenediamine-N,N,N',N'-tetramethylene phosphonic acid;
1,3-Propylenediamine-N,N,N',N'-tetramethylene phosphonic acid.

The ferric ion complex salt may be used alone or in combination in the form of previously prepared complex salt per se or may be formed in a solution using a ferric salt, such as ferric sulfate, ferric chloride, ferric nitrate, ferric ammonium sulfate or ferric phosphate, and a chelating agent such as aminopolycarboxylic acid, aminopolyphosphonic acid or phosphonocarboxylic acid. When the complex salt is formed in a solution, one or more ferric salts may be used, and one or more chelating agents may also be used. In either case of the previously prepared complex salt or the in situ formed one, the chelating agent may be used in an excess amount greater than that required to form the desired ferric ion salt. Among these iron complexes, preferred is a complex of ferric ion with aminopolycarboxylic acid and the amount thereof is 0.1 to 1 mole/l, preferably 0.2 to 0.4 moles/l in the case of the bleaching solution for photographic color lightsensitive materials such as color negative films. On the other hand, the compound is used in an amount of 0.05 to 0.5 moles/l, preferably 0.1 to 0.3 moles/l in the bleaching and fixing solution therefor. Moreover, it is used in an amount of 0.03 to 0.3 moles/l, preferably 0.05 to 0.2 moles/l in the case of the bleaching and bleaching-fixing solutions for color lightsensitive materials for print such as color paper.

To the bleaching solution or the bleaching-fixing solution, there may be added a bleaching accelerator, if desired. Examples of such useful bleaching accelerators include compounds having a mercapto group or a disulfide group therein such as those disclosed in U.S. Pat. No. 3,893,858; German Pat. Nos. 1,290,812 and 2,059,988; J. P. KOKAI Nos. 53-32736, 53-57831, 53-37418, 53-65732, 53-72623, 53-95630, 53-95631, 53-104232, 53-124424, 53-141623 and 53-28426; and Research Disclosure No. 17129 (July, 1978); thiazolidine derivatives such as those disclosed in J. P. KOKAI No. 50-140129; thiourea derivatives such as those disclosed in Japanese Patent Publication for Opposition Purpose (hereinafter referred to as J. P. KOKOKU) No. 45-8506, J. P. KOKAI Nos. 52-20832 and 53-32735 and U.S. Pat. No. 3,706,561; iodides such as those disclosed in German Pat. No. 1,127,715 and J. P. KOKAI No. 58-16235; polyethylene oxides such as those disclosed in German Pat. Nos. 966,410 and 2,748,430; polyamine compounds such as those disclosed in J. P. KOKOKU No. 45-8836; as well as compounds disclosed in J. P. KOKAI Nos. 49-42434, 49-59644, 53-94927, 54-35727, 55-26506 and 58-163940; and iodine and bromine ions. From the viewpoint of a high acceleration effect, preferred are compounds having a mercapto group or a disulfide group among others and in particular those disclosed in U.S. Pat. No. 3,893,858; German Pat. No. 1,290,812 and J. P. KOKAI No. 53-95630 are preferred.

Into the bleaching or bleaching-fixing solution bromides such as potassium bromide, sodium bromide and ammonium bromide; chlorides such as potassium chloride, sodium chloride and ammonium chloride; or iodides such as ammonium iodide may be incorporated as a rehalogenating agent. If necessary, one or more inorganic or organic acids and alkali metal or ammonium salt thereof having pH buffering ability, such as boric acid, borax, sodium metaborate, acetic acid, sodium acetate, sodium carbonate, potassium carbonate, phosphorous acid, phosphoric acid, sodium phosphate, citric acid, sodium citrate and tartaric acid; and anticorrosives such as ammonium nitrate and guanidine may be added.

The fixing agent used in the fixing or bleaching-fixing solution may be any conventional one, for instance, thiosulfates such as sodium thiosulfate and ammonium thiosulfate; thiocyanates such as sodium thiocyanate and ammonium thiocyanate; thioethers and thioureas such as ethylenebisthioglycollic acid, 3,6-dithia-1,8-octanediol, which are water-soluble, silver halide-solubilizing agents. These agents may be used alone or in combination. Further, the special bleaching-fixing solution consisting of a combination of a fixing agent and a large amount of halide such as potassium iodide described in J. P. KOKAI No. 51-155354 may be used in the bleaching-fixing process of the method of this invention. Preferred are thiosulfates, in particular, ammonium thiosulfate.

The concentration of the fixing agent in the fixing or bleaching-fixing solution is preferably 0.3 to 2 moles/l. In particular, in the case of processing photographic color lightsensitive materials, the amount thereof is 0.8 to 1.5 moles/l and in the case of color lightsensitive materials for print, it ranges from 0.5 to 1 mole/l.

Generally, the pH value of the fixing or bleaching-fixing solution is preferably 3 to 10, more preferably 5 to 9. This is because, if pH is less than the lower limit, the desilvering effect is enhanced. However, the solutions are greatly impaired and the cyan dye tends to be converted to leuco dye, while if pH is more than the upper limit, the rate of desilvering is extremely lowered and there is a strong tendency to cause stains.

In order to adjust pH, there may be added to the solutions, for instance, hydrochloric acid, sulfuric acid, nitric acid, acetic acid, bicarbonates, ammonia, caustic soda, caustic potash, sodium carbonate and potassium carbonate, if desired.

Further, various fluorescent brighteners, defoaming agents or surfactants, polyvinylpyrrolidone or organic solvents such as methanol may also be added to the bleaching-fixing solution.

The bleaching solution and bleaching-fixing solution as used herein contain a sulfite ion releasing compound, as the preservative, i.e., a sulfite such as sodium sulfite, potassium sulfite or ammonium sulfite; a bisulfite such as ammonium bisulfite, sodium bisulfite or potassium bisulfite; and a metabisulfite such as potassium metabisulfite, sodium metabisulfite or ammonium metabisulfite. These compounds are preferably present, in such solutions, in an amount of about 0.02 to 0.50 moles/l expressed as the amount of sulfite ions and more preferably 0.04 to 0.40 moles/l.

Furthermore, other preservatives such as ascorbic acid, carbonyl-bisulfite adducts or carbonyl compounds may be employed although the bisulfites are generally used as the preservative.

In addition to the foregoing compounds, it is also possible to add buffering agents, fluorescent brighteners, chelating agents and mold controlling agents.

The silver halide photographic lightsensitive materials to which the processing method according to the present invention is applied are, for instance, monochromatic color photographic lightsensitive materials which comprises a substrate and a single lightsensitive silver halide emulsion layer applied thereon and multilayered color photographic lightsensitive materials which comprises a substrate and at least two lightsensitive silver halide emulsion layers having different spectral sensitivities, for instance, color negative films, color reversal films, color paper, direct positive color lightsensitive materials, color reversal paper. In addition, the method may also be applied to the processing of monochromatic lightsensitive materials such as those for medical use and for making lithographic printing plates.

The multilayered color photographic materials comprise at least one red-sensitive emulsion layer, at least one green-sensitive emulsion layer and at least one blue-sensitive emulsion layer on the substrate. The order of these layers on the substrate is not restricted to a specific one and these may be arranged in any orders. In general, a cyan dye-forming coupler is added to the red-sensitive emulsion layer, a magenta dye-forming coupler is added to the green-sensitive emulsion layer and a yellow dye-forming coupler is added to the blue-sensitive emulsion layer, but, different combinations may be adopted if necessary.

Color couplers usable in the photographic material are cyan, magenta and yellow dye-forming couplers and typical examples thereof include naphtholic or phenolic compounds, pyrazolone or pyrazoloazole type compounds and linear or heterocyclic ketomethylene compounds. Specific examples of these cyan-, magenta- and yellow-dye forming couplers usable in the present invention are disclosed in the patents cited in Research Disclosure No. 17643 (December, 1978), VII-D; and No. 18717 (November, 1979).

Color couplers included in the lightsensitive materials are preferably made non-diffusible by imparting thereto ballast groups or polymerizing them. In the present invention, 2-equivalent color couplers in which the active site for coupling is substituted with an elimination group is rather preferred than 4-equivalent color couplers in which the active site for coupling is hydrogen atom, this is because the amount of coated silver may, thereby, be reduced and the lightsensitive layer obtained has a high sensitivity. Furthermore, couplers in which a formed dye has a proper diffusibility, non-color couplers, DIR couplers which can release a development inhibitor through the coupling reaction or couplers which can release a development accelerator may also be used.

A typical yellow coupler usable in the photographic material is an acylacetamide coupler of an oil protect type. Examples of such yellow couplers are disclosed in U.S. Pat. Nos. 2,407,210; 2,875,057; and 3,265,506. 2-Equivalent yellow couplers are preferably used as already explained above. Typical examples thereof are the yellow couplers of an oxygen atom elimination type described in U.S. Pat. Nos. 3,408,194; 3,447,928; 3,933,501; and 4,022,620, or the yellow couplers of a nitrogen atom elimination type described in J. P. KOKOKU No. 58-10739, U.S. Pat. Nos. 4,401,752; 4,326,024, Research Disclosure (RD) No. 18053 (April, 1979), U.K. Pat. No. 1,425,020, DEOS Nos. 2,219,917; 2,261,361; 2,329,587; and 2,433,812. Alpha-pivaloyl acetanilide type couplers are excellent in fastness, particularly light fastness, of formed dye. On the other hand, alpha-benzoyl acetanilide type couplers yield high color density.

Magenta couplers usable in the photographic material include couplers of an oil protect type of indazolone, cyanoacetyl, or, preferably, pyrazoloazole type ones such as 5-pyrazolones and pyrazolotriazoles. Among 5-pyrazolone type couplers, couplers whose 3-position is substituted with an arylamino or acylamino groups are preferred from the viewpoint of color phase and color density of the formed dye. Typical examples thereof are disclosed in U.S. Pat. Nos. 2,311,082; 2,343,703; 2,600,788; 2,908,573; 3,062,653; 3,152,896; and 3,936,015. An elimination group of the 2-equivalent 5-pyrazolone type couplers is preferably a nitrogen atom elimination group described in U.S. Pat. No. 4,310,619 and an arylthio group described in U.S. Pat. No. 4,351,897. The 5-pyrazolone type coupler having ballast groups such as those described in European Pat. No. 73,636 provides high color density.

Examples of pyrazoloazole type couplers include pyrazolobenzimidazoles such as those disclosed in U.S. Pat. No. 3,369,879, preferably pyrazolo(5,1-c)(1,2,4)triazoles such as those disclosed in U.S. Pat. No. 3,725,067, pyrazolotetrazoles such as those disclosed in Research Disclosure No. 24220 (June, 1984) and such pyrazolopyrazoles as those disclosed in Research Disclosure No. 24230 (June, 1984). Imidazo(1,2-b)pyrazoles such as those disclosed in European Pat. No. 119,741 are preferred on account of small yellow minor absorption of formed dye and light fastness. Pyrazolo(1,5-b)(1,2,4)triazoles such as those disclosed in European Pat. No. 119,860 are particularly preferred.

Cyan couplers usable in the photographic material include naphtholic or phenolic couplers of an oil protect type. Typical examples of naphthol type couplers are those disclosed in U.S. Pat. No. 2,474,293. Typical preferred 2-equivalent naphtholic couplers of oxygen atom elimination type are described in U.S. Pat. Nos. 4,052,212; 4,146,396; 4,228,233; and 4,296,200. Exemplary phenol type couplers are those described in U.S. Pat. Nos. 2,369,929; 2,801,171; 2,772,162; and 2,895,826.

Cyan couplers resistant to humidity and heat are preferably used in the present invention. Examples of such couplers are phenol type cyan couplers having an alkyl group higher than methyl group at a metha-position of a phenolic nucleus as described in U.S. Pat. No. 3,772,002; 2,5-diacylamino-substituted phenol type couplers as described in U.S. Pat. Nos. 2,772,162; 3,758,308; 4,126,396; 4,334,011; and 4,327,173; DEOS No. 3,329,729; and Japanese Patent Application Serial No. 58-42671; and phenol type couplers having a phenylureido group at 2-position and an acylamino group at the 5-position of the phenol nucleus as described in U.S. Pat. Nos. 3,446,622; 4,333,999; 4,451,559; and 4,427,767.

Cyan couplers in which 5-position of naphthol nucleus is substituted with a sulfonamide or carbonamide group as described in European Pat. No. 161,626 A are also excellent in fastness of formed image and may also be preferably used in the present invention.

In order to compensate unnecessary absorption, in the short wave length region, of dyes formed from magenta and cyan couplers, it is preferred to use a colored coupler together in color lightsensitive materials used for taking photographs. Examples thereof are the yellow colored magenta couplers described in U.S. Pat. No. 4,163,670 and J. P. KOKOKU No. 57-39413 and the magenta colored cyan couplers described in U.S. Pat. Nos. 4,004,929 and 4,138,258, and U.K. Pat. No. 1,146,368.

Graininess may be improved by using together a coupler which can form a dye having a moderate diffusibility. As such blur couplers, some magenta couplers are specifically described in U.S. Pat. No. 4,366,237 and U.K. Pat. No. 2,125,570 and some yellow, magenta and cyan couplers are specifically described in European Pat. No. 96,570 and DEOS No. 3,234,533.

Dye-forming couplers and the aforementioned special couplers may be a dimer or a higher polymer. Typical examples of such polymerized dye-forming couplers are described in U.S. Pat. Nos. 3,451,820 and 4,080,211. Examples of such polymerized magenta couplers are described in U.K. Pat. No. 2,102,173 and U.S. Pat. No. 4,367,282.

These couplers may be 2-equivalent type or 4-equivalent type with respect to silver ions. Moreover, they may be a colored coupler having color compensation effect or a coupler which release a development inhibitor in the course of the development (so-called DIR couplers).

In addition to DIR couplers, the lightsensitive materials may contain a colorless DIR coupling compound whose coupling reaction product is colorless and which can release a development inhibitor. The lightsensitive materials may further contain other compounds which may release a development inhibitor during the development, other than DIR couplers.

Gelatin as used in the lightsensitive materials processed according to the method of the present invention may be either lime-treated ones or acid-treated ones. The method for preparing such a gelatin is described, in detail, in the article of Arthur Weiss entitled "The Macromolecular Chemistry of Gelatin", Academic Press (1964).

The silver halide emulsion of the lightsensitive material which is treated according to the method of this invention may be one containing silver chloride, silver bromide and/or silver iodide in any ratio. However, in the case of color paper, the emulsion preferably includes silver chlorobromide substantially free from silver iodide. In this connection, the term "substantially free from silver iodide" herein means that the amount of silver iodide with respect to the total amount of silver halides is not more than 3 mole%, preferably 2 mole% or less, more preferably 0.5 mole% or less and most preferably 0 mole%.

The emulsion of color paper preferably processed according to the method of this invention is silver chlorobromide emulsion in which the content of silver bromide is not less than 10 mole%. In particular, in order to obtain an emulsion having a sufficient density without increasing fogging, it is preferable to use silver chlorobromide having a silver bromide content of not less than 20 mole%. On the contrary, if a quick treatment in which the development time and the like are shortened is required, it is preferable to use silver chlorobromide emulsion having a silver bromide content of 10 mole% or less, in particular to employ the emulsion containing not more than 3 mole% of silver bromide. It is further preferable to use silver chloride emulsion substantially free from silver bromide (AgBr content of not more than 1 mole%).

The reduction of the silver bromide content in the emulsion not only leads to the enhancement of the development speed but also makes it possible to maintain the development activity by simply replenishing a smaller amount of replenishers, since the amount of bromide ions dissolved out from the lightsensitive material containing the same during developing treatment are lowered.

Moreover, if the lightsensitive material is a color negative film, it is common to use silver iodobromide or iodochlorobromide emulsion containing not more than 30 mole% of silver halide. However, it is particularly preferred to use those having AgI content of 2 to 25 mole%. In this respect, if it is intended to achieve a quick development and to reduce the amount of replenishers, those containing not more than 2 mole% of silver iodide are preferably employed and particularly preferred are silver chlorobromide or silver chloride substantially free from AgI (content thereof being not more than 1 mole%).

The silver halide grains in the photographic emulsions may be so-called regular grains having a regular crystal form such as cubic, octahedron, dodecahedron and tetradecahedron. Alternatively, the grains may be of an irregular crystal structure such as spherical, or ones having crystal defects such as a twinning plane, or a composite form thereof.

Regarding a grain size of silver halide, the grains may be fine grain of about 0.1μ or less, or may be large size grains having a diameter of the projected area of up to about 10μ. Moreover, they may be monodisperse grains having a narrow size distribution or polydisperse grains having a broad size distribution.

The silver halide photographic emulsion usable in the method of this invention may be prepared according to any known methods, for instance, those disclosed in Research Disclosure (RD), No. 17643 (December, 1978), pp 22–23, "I. Emulsion Preparation and Types" and ibid., No. 18716 (November, 1979), p 648.

A typical monodisperse emulsion contains silver halide whose average grain size is larger than about 0.1μ and of which at least about 95% by weight has a grain size within the average grain size ±40%. An emulsion containing silver halide whose average grain size ranges from about 0.25 to 2μ and of which at least about 95% by weight or by number has a grain size within the average grain size ±20% may be processed according to the method of this invention.

In addition, the emulsion containing flat silver halide grains having an aspect ratio of not less than about 5 may be processed according to the method of this invention. Such flat (or plate-like) grain may easily be prepared according to, for instance, methods disclosed in Gutoff, Photographic Science and Engineering, 1970, 14,, pp 248–257; U.S. Pat. Nos. 4,434,226; 4,414,310; 4,433,048 and 4,439,520; and U.K. Pat. No. 2,112,157. When flat grains are used, a variety of advantages such as the enhancement in color sensitization efficiency due to sensitizing dyes; the improvement in graininess and the enhancement in sharpness can be attained. This is disclosed in U.S. Pat. No. 4,434,226 in detail.

The crystal structure of the silver halide grains may be uniform or abnormal in which the composition is different between the outer part and the inner part thereof. A typical example of those having different compositions is core-shell type or double structure type grains in which the composition of the surface layer thereof differs from that of the internal layer. In such grains, the shape of the care is identical with or different from the overall shape including the shell. Specifically, the shape of core is cubic while that of the overall grain including shell is cubic or octahedron or vice versa.

Moreover, the crystalline structure may be triple structure or a higher multistructure or the grains may be composed of those having a double structure and a thin surface layer formed thereon and having a silver halide composition different from that of the grain.

In the lightsensitive materials processed according to the method of this invention, there are preferably used silver halide emulsions comprising grains having any structures rather than those comprising grains which have uniform composition throughout the grain, with respect to the silver halide composition. The grains of which silver bromide content is low at the surface region thereof compared with that inside thereof are preferably used in silver chlorobromide emulsions which are used for making color paper. Typical examples thereof are core-shell type emulsions containing silver bromide of which content at the core portion is higher than that observed at the shell portion. The difference in silver bromide content between the core and shell portions is preferably not less than 3 mole% and not more than 95 mole% and the ratio of the amount of silver present in the core to that in the shell preferably ranges from 5:95 to 95:5 (molar ratio) and more preferably 7:93 to 90:10.

In addition, the silver iodide content observed at the core portion is greater than that observed at the shell portion in silver iodobromide emulsions used to form color negative films and the silver iodide content at the core portion ranges from 10 to 45 mole%, preferably from 15 to 40 mole%, while that at the shell portion falls within the range of not more than 5 mole%, in particular not more than 2 mole%. The ratio between the amounts of silver at the core and the shell portions ranges from 15:85 to 85:15, preferably 15:85 to 75:25.

Examples of such emulsions are disclosed in, for instance, U.K. Pat. No. 1,027,146, U.S. Pat. Nos. 3,505,068 and 4,444,877 and Japanese Patent Application Serial No. 58-248469.

The photographic emulsions as used herein may contain a variety of compounds for the purposes of preventing fogging and stabilizing the photographic quality during the preparation of the lightsensitive materials, the storage thereof or the photographic treatment thereof. As such compounds, there may be mentioned such azoles as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (in particular, 1-phenyl-5-mercaptotetrazole); mercaptopyrimidines; mercaptotriazines; such thioketo compounds as oxazolinethione; such azaindenes as triazaindenes, tetrazaindenes (in particular, 4-hydroxy-substituted-(1,3,3a,7)-tetrazaindenes) and pentazaindenes; benzenethiosulfonic acid, benzenesulfinic acid and benzenesulfonic acid amide.

The photographic emulsion layers or other hydrophilic colloidal layers of the lightsensitive materials as used herein may further contain various kinds of surfactants which act as a coating aid, an antistatic agent, an agent for improving slipping property thereof, an emulsifier or a dispersant, an agent for preventing adhesion and an agent for improving photographic performance such as development acceleration, contrast development and sensitization.

For the purposes of improving the sensitivity and contrast and accelerating the development, the photographic emulsion layers of the lightsensitive materials used may contain, for instance, polyalkylene oxide or ether-, ester- or amine-derivatives thereof, thioether compounds, thiomorpholines, quaternary ammonium salts, urethane derivatives, urea derivatives, imidazole derivatives and 3-pyrazolidones.

In the photographic lightsensitive materials as used herein, the photographic emulsion layers and other hydrophilic colloidal layers may further contain a dispersion of water-insoluble or hardly water-soluble synthetic polymer for the purposes of improving the dimensional stability thereof and the like.

Examples of such polymers include those having repeating units of monomers such as alkyl acrylates, alkyl methacrylates, alkoxyalkyl acrylates, alkoxyalkyl methacrylates, glycidyl acrylates, glycidyl methacrylates, acrylamides, methacrylamides, vinyl esters (eg., vinyl acetate), acrylonitrile, olefins, styrene or combinations thereof; or combinations of at least one of these with at least one monomer selected from the group consisting of acrylic acid, methacrylic acid, alpha, beta-unsaturated dicarboxylic acids, hydroxyalkyl acrylates, hydroxyalkyl methacrylates, sulfoalkyl acrylates, sulfoalkyl methacrylates and styrene sulfonic acid.

The photographic emulsions as used herein may spectrally be sensitized with methine dyes or others. Dyes to be used include cyanine dyes, merocyanine dyes, complex cyanine dyes, complex merocyanine dyes, holopolar cyanine dyes, hemicyanine dyes, styryl dyes and hemioxonol dyes. Particularly useful dyes are those belonging to cyanine dyes, merocyanine dyes and complex merocyanine dyes. In those dyes, any nuclei usually used in cyanine dyes may be adopted as basically reactive heterocylic nuclei. Examples of such nuclei include pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus; nuclei composed of an alicyclic hydrocarbon ring fused with one of the foregoing nuclei; and nuclei composed of an aromatic hydrocarbon ring fused with one of the foregoing nuclei such as indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus and quinoline nucleus. Those nuclei may have substitutents on their carbon atoms.

For merocyanine dyes or complex merocyanine dyes, 5- or 6 membered heterocyclic nuclei such as pyrrazolin-5-one nucleus, thiohydantoin nucleus, 2-thiooxazolidine-2,4-dione nucleus, thiazolidine-2,4-dione nucleus, rhodanine nucleus and thiobarbituric acid nucleus may be used as a nucleus having a ketomethylene structure.

Those sensitizing dyes may be used alone or in combination. A combination of sensitizing dyes are often used, particularly, for the purpose of supersensitization.

Substances having no spectral sensitization effect per se or substances absorbing substantially no visible light and exhibiting supersensitization effect may be incorporated into the emulsions together with the sensitizing dyes. For instance, aminostilbene compounds substituted with a nitrogen atom-containing heterocyclic group such as those disclosed in U.S. Pat. Nos. 2,933,390 and 3,635,721; organic aromatic acid-formaldehyde condensates such as those disclosed in U.S. Pat. No. 3,743,510; cadmium salts and azaindene compounds may be incorporated.

The photographic emulsion layers and other hydrophilic colloidal layers of the photographic lightsensitive materials processed according to the method of this invention may contain an organic or inorganic hardening agent. Examples of such hardening agents include chromates such as chromium alum and chromium acetate; aldehydes such as formaldehyde, glyoxal and glutaraldehyde; N-methylol compounds such as dimethylol urea and methylol dimethyl hydantoin; dioxane derivatives such as 2,3-dihydroxydioxane; active vinyl compounds such as 1,3,5-triacryloyl-hexahydro-s-triazine and 1,3-vinylsulfonyl-2-propanol; active halogen compounds such as 2,4-dichloro-6-hydroxy-s-triazine; mucohalogeno-acids such as mucochloric acid and mucophenoxychloric acid. These hardening agents may be used alone or in combination.

Where the hydrophilic colloidal layers of the photographic material contain dyes and/or ultraviolet absorbers, they may be stained with a cationic polymer.

The lightsensitive materials processed according to the method of this invention may contain an anticolorfoggant such as a hydroquinone derivative, an aminophenol derivative, a gallic acid derivative or an ascorbic acid derivative.

The lightsensitive materials processed according to the method of this invention may contain an ultraviolet absorber in the hydrophilic colloidal layers thereof. Examples of such ultraviolet absorbers include benzotriazole compounds substituted with an aryl group such as those disclosed in U.S. Pat. No. 3,533,794; 4-thiazolidone compounds such as those disclosed in U.S. Pat. Nos. 3,314,794 and 3,352,681; benzophenone compounds such as those disclosed in J. P. KOKAI No. 46-2784; cinnamate compounds such as those disclosed in U.S. Pat. Nos. 3,705,805 and 3,707,375; butadiene compounds such as those disclosed in U.S. Pat. No. 4,045,229; and benzoxazole compounds such as those disclosed in U.S. Pat. No. 3,700,455. Moreover, it may also possible to use, for instance, an ultraviolet absorbing coupler such as alpha-naphtholic cyan dye-forming couplers or an ultraviolet absorbing polymer. These ultraviolet absorbers may be stained in a specific layer of the lightsensitive materials.

The hydrophilic colloidal layers of the lightsensitive materials may contain a water-soluble dye as a filter dye or for a variety of purposes such as prevention of irradiation and the like. Examples of such dyes include oxonol dyes, hemioxonol dyes, styryl dyes, merocyanine dyes, cyanine dyes and azo dyes. Among these, oxonol dyes, hemioxonol dyes and merocyanine dyes are useful in the invention.

The lightsensitive materials may further contain the following known antidiscoloration agents or color image stabilizers. Those, to be incorporated into the lightsensitive materials, as used herein, may be used alone or in combination. Examples of the known antidiscoloration agents are hydroquinone derivatives, gallic acid derivatives, p-alkoxyphenols, p-oxyphenol derivatives and bisphenols.

The couplers as used herein may be incorporated into the lightsensitive materials in accordance with a variety of known dispersion methods.

Examples of high-boiling point solvents used in the oil-in-water dispersion method are disclosed in, for instance, U.S. Pat. No. 2,322,027.

The processes of a latex dispersion method, effects attained by the method and specific examples of latexes for impregnation are described in, for instance, U.S. Pat. No. 4,199,363 and OLS Nos. 2,541,274 and 2,541,230.

The method for processing silver halide photographic lightsensitive materials according to the present invention will hereunder be explained in more detail with reference to the following non-limitative working examples and the effects practically achieved according to the method of this invention will also be discussed in detail in comparison with the following comparative examples.

EXAMPLE 1

A multilayered color photographic paper having a layer structure as described below was prepared on a paper substrate, both surfaces of which were laminated with polyethylene films. Each coating liquid was prepared according to the following procedures

• Preparation of Coating Liquid for 1st Layer

To 19.1 g of an yellow coupler (ExY) and 4.4 g of a dye image stabilizer (Cpd-1) there were added 27.2 cc of ethyl acetate and 7.7 cc of solvent (Solv-1) and the resultant solution was dispersed in 185 cc of 10% aqueous gelatin solution containing 8 cc of 10% sodium dodecylbenzenesulfonate solution to form an emulsion. On the other hand, another emulsion was prepared by adding the following blue-sensitive sensitizing dye to a silver chlorobromide emulsion (AgBr content=80.0 mole%; Ag content=70 g/kg emulsion) in an amount of $5.0\times10^{-4}$ moles per mole of silver halide. These two emulsions prepared above were mixed with one another and adjusting the composition so as to be coinsident with that in Table I-1 to obtain a coating liquid for 1st layer. Other coating liquids for second to seventh layers were also prepared in the same manner as described above. As the hardening agent for gelatin in each layer, sodium salt of 1-oxy-3,5-dichloro-s-triazine was used.

As the spectral sensitizing dye in each layer, the following compounds were used.

Blue-sensitive Emulsion Layer

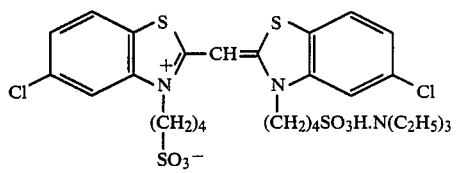

(Added amount=$5.0\times10^{-4}$ moles per mole of silver halide)

Green-sensitive Emulsion Layer

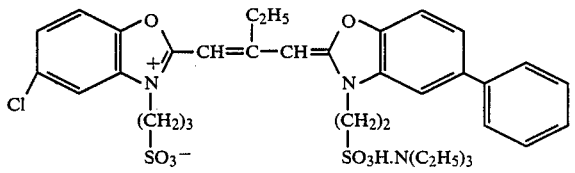

(Added amount=$4.0\times10^{-4}$ moles per mole of silver halide)

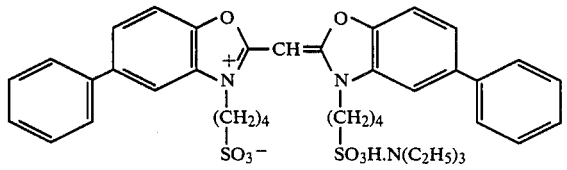

(Added amount=$7.0\times10^{-5}$ moles per mole of silver halide)

Red-sensitive Emulsion Layer

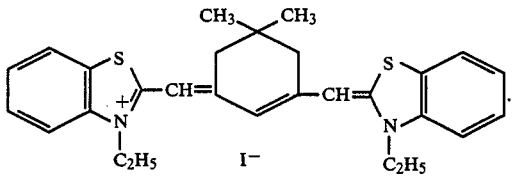

(Added amount $=0.9\times10^{-4}$ moles per mole of silver halide)

The following compound was added to the red-sensitive emulsion layer in an amount of $2.6\times10^{-3}$ moles per mole of silver halide:

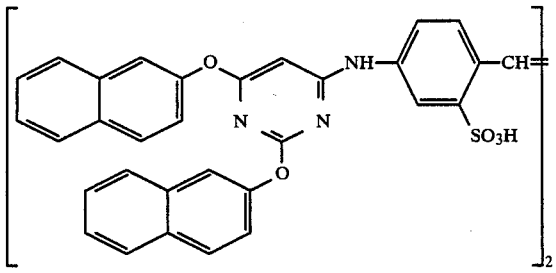

Moreover, to each of the blue-sensitive emulsion layer, the green-sensitive emulsion layer and the red-sensitive emulsion layer, there was added 1-(5-methylureidophenyl)-5-mercaptotetrazole in an amount of $4.0\times10^{-6}$, $3.0\times10^{-5}$ or $1.0\times10^{-5}$ moles per mole of silver halide respectively. Further, 4-hydroxy-6-methyl-1,3,3a,7-tetrazaindene was added to the blue-sensitive emulsion layer and the green-sensitive emulsion layer in an amount of $1.2\times10^{-2}$ and $1.1\times10^{-2}$ moles per mole of silver halide respectively.

For the purpose of preventing irradiation, the following dyes were added to the emulsion layers:

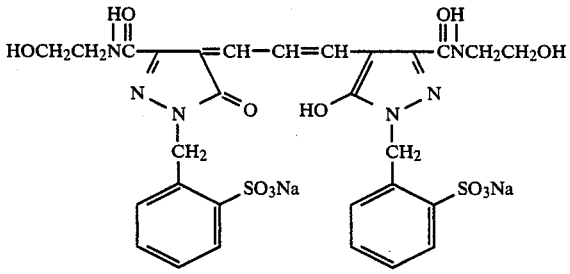

and

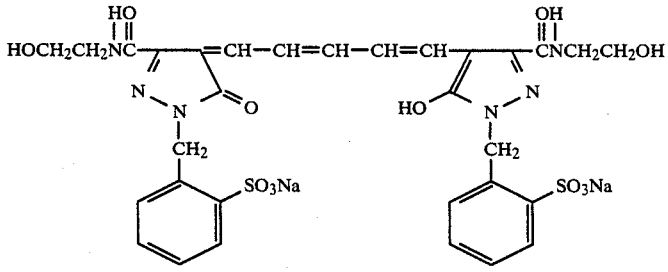

(Layer Structure)

The composition of each layer is given in Table I-1. In Table I-1, each numerical value represents the coated amount (g/m²). The coated amount of silver halide emulsion is expressed as the reduced amount of coated silver.

TABLE I-1

| Layer | Principal Composition | Amount Used |
|---|---|---|
| 7th layer (Protective layer) | Gelatin | 1.33 |
| | Acrylic acid modified polyvinyl alcohol copolymer (degree of modification = 17%) | 0.17 |
| | Liquid paraffin | 0.03 |
| 6th layer (UV absorbing layer) | Gelatin | 0.53 |
| | UV absorber (UV-1) | 0.21 |
| | Solvent (Solv-3) | 0.08 |
| 5th layer (Red-sensitive layer) | Silver halide emulsion (Br: 70%) | 0.23 |
| | Gelatin | 1.34 |
| | Cyan coupler (ExC) | 0.34 |
| | Dye image stabilizer (Cpd-6) | 0.17 |
| | Polymer (Cpd-7) | 0.40 |
| | Solvent (Solv-4) | 0.23 |
| 4th layer (UV absorbing layer) | Gelatin | 1.58 |
| | UV absorber (UV-1) | 0.62 |
| | Color mixing inhibitor (Cpd-5) | 0.05 |
| | Solvent (Solv-3) | 0.24 |
| 3rd layer (Green-sensitive layer) | Silver halide emulsion (Br: 80%) | 0.16 |
| | Gelatin | 1.79 |
| | Magenta coupler (ExM) | 0.32 |
| | Dye image stabilizer (Cpd-3) | 0.20 |
| | Dye image stabilizer (Cpd-4) | 0.01 |
| | Dye image stabilizer (Cpd-8) | 0.03 |
| | Dye image stabilizer (Cpd-9) | 0.03 |
| | Solvent (Solv-2) | 0.65 |
| 2nd layer (Color mixing inhibiting layer) | Gelatin | 0.99 |
| | Color mixing inhibitor (Cpd-2) | 0.08 |
| 1st layer (Blue-sensitive layer) | Silver halide emulsion (Br: 80%) | 0.26 |
| | Gelatin | 1.83 |
| | Yellow coupler (ExY) | 0.83 |
| | Dye image stabilizer (Cpd-1) | 0.19 |
| | Solvent (Solv-1) | 0.35 |
| Substrate | Paper laminated with polyethylene films (the polyethylene film situated at the side of 1st layer contains a white pigment $TiO_2$) and a bluing dye (Ultramarine Blue)) | |

The emulsion used in each layer was as follows:

| Average | Average Particle | Cieffi-cient of |
|---|---|---|

TABLE I-1-continued
| | Composition | Size (μ) | Variation | Form |
|---|---|---|---|---|
| Blue-sensitive emulsion layer | AgBrCl (Br: 80 mole %) | 0.81 | 0.11 | Cubic |
| Green-sensitive emulsion layer | AgBrCl (Br: 80 mole %) | 0.43 | 0.09 | " |
| Red-sensitive emulsion layer | AgBrCl (Br: 70 mole %) | 0.55 | 0.10 | " |
(ExY) Yellow Coupler
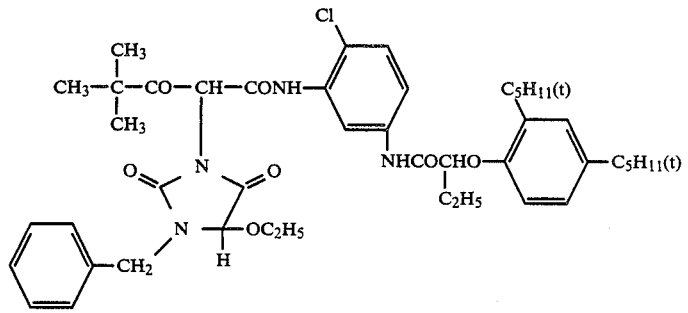
(ExM) Magenta Coupler
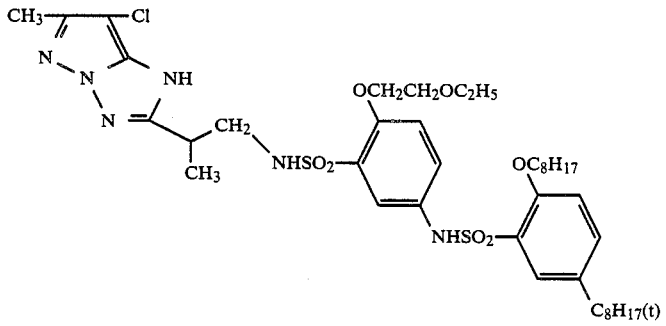
(ExC) Cyan Coupler
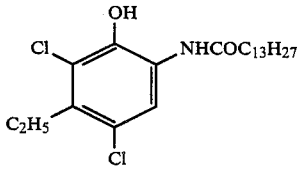
(Cpd-1) Dye Image Stabilizer
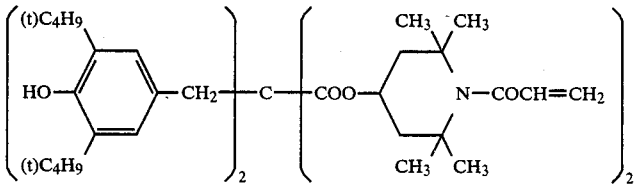
(Cpd-2) Color Mixing Inhibitor
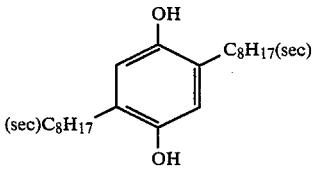
(Cpd-3) Dye Image Stabilizer -continued
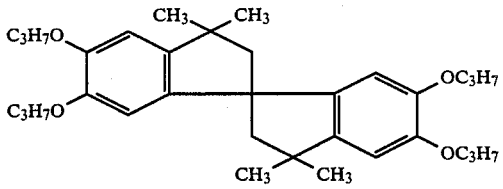
(Cpd-4) Dye Image Stabilizer
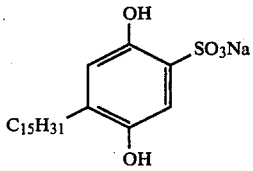
(Cpd-5) Color Mixing Inhibitor
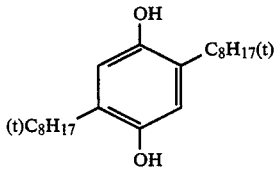
(Cpd-6) Dye Image Stabilizer
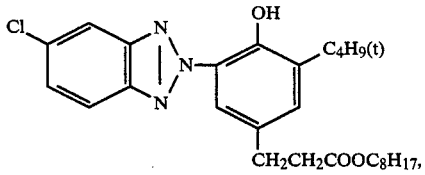
($m_1$)
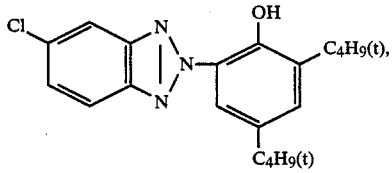
($m_2$)
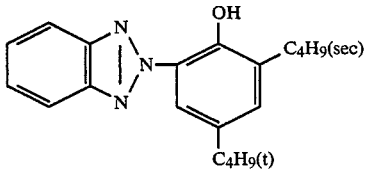
($m_3$)
5:8:9 (weight ratio) mixture of ($m_1$), ($m_2$) and ($m_3$)
(Cpd-7) Polymer
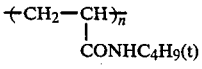
Average Molecular Weight: 60,000
(Cpd-8) Dye Image Stabilizer
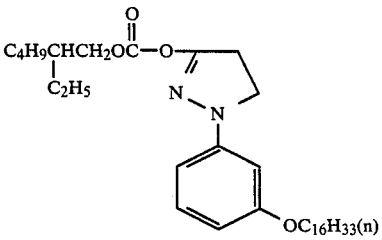
(Cpd-9) Dye Image Stabilizer -continued

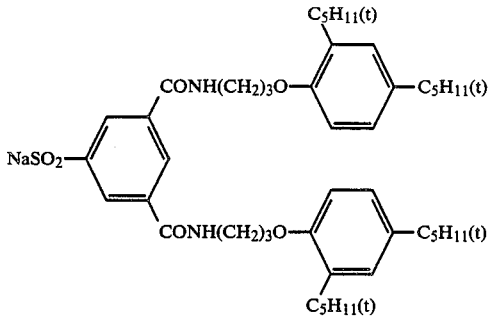

(UV-1) UV Absorber

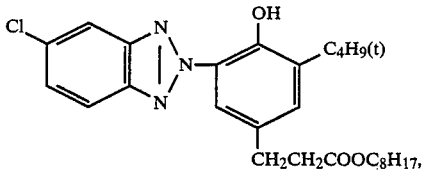

(i1)

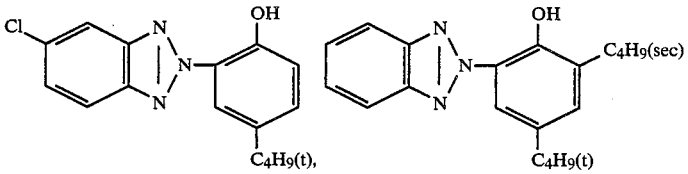

(i2) (i3)

2:9:8 (weight ratio) mixture of (i1), (i2) and (i3)

(Solv-1) Solvent

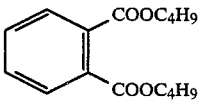

(Solv-2) Solvent

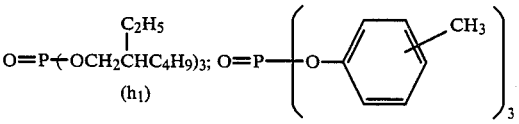

(h1) (h2)

2:1 (volume ratio) mixture of (h1) and (h2)

Solvent (Solv-3)

$O{=}P{+}O{-}C_9H_{19}(iso))_3$

Solvent (Solv-4)

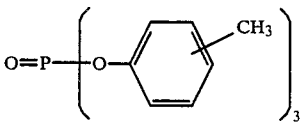

The sample thus prepared was cut into long band-like films of 82.5 mm wide, they were imagewise exposed to light by an autoprinter and then processed, using 4 kinds of washing water, by an autodeveloping machine according to the following processing steps (see Table I-2) at a rate of 60 m/day for 4 weeks (practical operation time=24 days). In addition, the amount of the bleaching-fixing solution carried over to the water washing process was estimated to be 2.5 ml per unit length (1 m) of the sample (82.5 mm wide).

TABLE I-2

| Steps | Temp. (°C.) | Time (sec.) | Amount Replenished[1] (ml) |
|---|---|---|---|
| Color Development | 38 | 100 | 24 |
| Bleaching-Fixing | 33 | 60 | 10 |
| | | | Whole of the overflow from Water Washing (1) was introduced. |
| Water Washing (1) | 33 | 20 | |
| | | | Four baths-counter-current system from (4) to (1). |
| Water Washing (2) | 33 | 20 | |
| Water Washing (3) | 33 | 20 | |
| Water Washing (4) | 33 | 20 | 10 |
| Drying | 75 | | |

In this processing, the volume of the color development bath was 17 l, that of the bleaching-fixing bath was 10 l and that of each water washing bath was 4 l. Further, the autodeveloping machine herein used was PROCESSOR PP-600 for MINILABO 23S (available from Fuji Photo Film Co., Ltd.).

Each of the processing solutions used in these steps had the following composition:

Color Development Solution

| Component | Tank Solution (g) | Replenisher (g) |
|---|---|---|
| Water | 800 (ml) | 800 (ml) |
| Diethylenetriaminepentaacetic acid | 1.0 | 1.0 |
| 1-Hydroxyethylidene-1,1-diphosphonic acid (60% solution) | 2.0 | 2.0 |
| Nitrilotriacetic acid | 2.0 | 2.0 |
| 1,4-Diazabicyclo(2,2,2)octane Compound | 4.0 | 4.8 |
| Potassium bromide | 0.5 | — |
| Potassium carbonate | 30 | 35 |
| N—Ethyl-N—(β-methanesulfonamidethyl)-3-methyl-4-aminoaniline sulfate | 5.5 | 7.5 |
| Diethylhydroxylamine | 4.0 | 4.5 |
| Fluorescent brightener (UVITEX-CK; available from Ciba Geigy) | 1.5 | 2.0 |
| Water | to 1,000 ml | 1,000 ml |
| pH (at 25° C.) | 10.25 | 10.60 |

Bleaching-Fixing Solution

| Component | Tank Solution (g) | Replenisher (g) |
|---|---|---|
| Water | 400 (ml) | 400 (ml) |
| Ammonium thiosulfate (70% solution) | 200 (ml) | 400 (ml) |
| Sodium sulfite | 20 | 40 |
| Ferric ammonium ethylenediaminetetraacetate | 60 | 120 |
| Disodium ethylenediaminetetraacetate | 10 | 20 |
| Water | to 1,000 (ml) | 1,000 (ml) |
| pH (at 25° C.): adjusted by the addition of ammonia | 7.00 | 6.70 |

Washing Water: Compositions of tank solution and replenisher are equivalent with one another.

| Washing Water I: Tap Water | |
|---|---|
| Calcium | 45 mg/l |
| Magnesium | 7 mg/l |
| pH | 7.0 |
| Conductivity | 370 μS/cm |

Washing Water II: This was obtained by adding 0.2 g of 5-chloro-2-methyl-4-isothiazolin-3-one per liter of tap water (Washing Water I). (See Example 2 in J. P. KOKAI No. 60-235133).

Conductivity 380 μS/cm

Washing Water III: This was prepared by passing tap water through a mixed bed type column packed with an H-type strong acidic cation exchange resin (available from Rohm & Haas Co. under the trade name of Amberlite IR-120B) and an OH-type anion exchange resin (available from the same Company under the trade name of Amberlite IR-400) and exhibited the following properties:

| | |
|---|---|
| Calcium | 0.3 mg/l |
| Magnesium | ≦0.1 mg/l |
| pH | 6.5 |
| Conductivity | 5.0 μS/cm |

Washing Water IV: This was obtained by adding, to Washing Water III, 20 mg/l of sodium dichloroisocyanurate and 130 mg/l of anhydrous sodium sulfate and had the following properties:

| | |
|---|---|
| Calcium | 0.3 mg/l |
| Magnesium | ≦0.1 mg/l |
| pH | 6.6 |
| Conductivity | 150 μS/cm |

After the completion of 4-week processing, inspections of proliferation of bacteria and/or mold in each water washing bath, contamination of the processed paper, contamination of conveyor rollers, adhesion of deposits thereon and yellow stain were carried out and the results thus obtained were summarized in Table II below.

In this connection, the yellow stain was determined by processing non-exposed paper and measuring yellow density (reflection density) using Macbeth's Densitometer.

TABLE II

| | Washing Water | Bacteria, Mold in Water Washing Bath | Contamination of Processed Paper | Contamination, Deposites on Conveyor Roller | Yellow Stain |
|---|---|---|---|---|---|
| Comp. Ex. | I | ++ | ++ | ++ | 0.16 |
| Comp. Ex. | II | + | − | ++ | 0.13 |
| Present Invention | III | + | − | − | 0.07 |
| Present Invention | IV | − | − | − | 0.07 |

Explanation of ideograms appearing in Table II:
++: observed in great degree
+: observed in small degree
−: not observed As shown in Table II, it is clear that the present invention makes it possible to substantially suppress the proliferation of bacetria, mold in water washing baths; to prevent the contamination of the conveyor rollers and the formation of deposits thereon; and to prevent the yellow stain from causing. Therefore, the purposes of the present invention were surely achieved.

EXAMPLE 2

There was prepared a multilayered color lightsensitive material (hereunder referred to as Sample 101) by applying, in order, the following layers each of which had the composition given below, on a substrate of cellulose triacetate film provided with an underlying coating.

(Composition of the Lightsensitive Layer)

In the following composition, the coated amount of silver halide and colloidal silver was expressed as a reduced amount of elemental silver (g/m$^2$), that of coupler, additives and gelatin was expressed as g/m$^2$, and that of sensitizing dye were expressed as moler amount per unit mole of silver halide included in the same layer.

1st Layer: Antihalation Layer

| | |
|---|---|
| Black colloidal silver | 0.2 |
| Gelatin | 1.3 |
| ExM-8 | 0.06 |
| UV-1 | 0.1 |
| UV-2 | 0.2 |
| Solv-1 | 0.01 |
| Solv-2 | 0.01 |

2nd Layer: Intermediate Layer

| | |
|---|---|
| Silver bromide of fine grain (average grain size = 0.07 μ) | 0.10 (Ag) |
| Gelatin | 1.5 |
| UV-1 | 0.06 |
| UV-2 | 0.03 |
| ExC-2 | 0.02 |
| ExF-1 | 0.004 |
| Solv-1 | 0.1 |
| Solv-2 | 0.09 |

3rd Layer: First Red-sensitive Emulsion Layer

| | |
|---|---|
| Silver iodobromide emulsion (AgI content = 2 mole %; a type in which the content of AgI is high inside thereof; diameter corresponding to sphere = 0.3 μ, coefficient of variation thereof = 29%; mixed grains of regular crystals and twin crystals; ratio, diameter/thickness = 2.5) | 0.4 (Ag) |
| Gelatin | 0.6 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.06 |
| ExC-4 | 0.06 |
| ExC-7 | 0.04 |
| ExC-2 | 0.03 |
| Solv-1 | 0.03 |
| Solv-3 | 0.012 |

4th Layer: Second Red-sensitive Emulsion Layer

| | |
|---|---|
| Silver iodobromide emulsion (AgI content = 5 mole %; a type in which AgI content is high inside thereof; diameter corresponding to sphere = 0.7 μ, coefficient of variation thereof = 25%; mixed grains of regular crystals and twin crystals; diameter/thickness ratio = 4) | 0.7 (Ag) |
| ExS-1 | $1 \times 10^{-4}$ |
| ExS-2 | $3 \times 10^{-4}$ |
| ExS-3 | $1 \times 10^{-5}$ |
| ExC-3 | 0.24 |
| ExC-4 | 0.24 |
| ExC-7 | 0.04 |
| ExC-2 | 0.04 |
| Solv-1 | 0.15 |
| Solv-3 | 0.02 |

5th Layer: Third Red-sensitive Emulsion Layer

| | |
|---|---|
| Silver iodobromide emulsion (AgI content = 10 mole %; AgI content is high inside thereof; diameter corresponding to sphere = 0.8 μ, coefficient of variation thereof = 16%; mixed grains of regular crystals and twin crystals; diameter/thickness ratio = 1.3) | 1.0 (Ag) |
| Gelatin | 1.0 |
| ExS-1 | $1 \times 10^{-4}$ |
| ExS-2 | $3 \times 10^{-4}$ |
| ExS-3 | $1 \times 10^{-5}$ |
| ExC-5 | 0.05 |
| ExC-6 | 0.1 |
| Solv-1 | 0.01 |
| Solv-2 | 0.05 |

6th Layer: Intermediate Layer

| | |
|---|---|
| Gelatin | 1.0 |
| Cpd-1 | 0.03 |
| Solv-1 | 0.05 |

7th Layer: First Green-sensitive Emulsion Layer

| | |
|---|---|
| Silver iodobromide emulsion (AgI content = 2 mole %; a type in which AgI content in high inside thereof; diameter corresponding to sphere = 0.3 μ, coefficient of variation thereof = 28%; mixed grains of regular crystals and twin crystals; diameter/thickness ratio = 2.5) | 0.30 (Ag) |
| ExS-4 | $5 \times 10^{-4}$ |
| ExS-6 | $0.3 \times 10^{-4}$ |
| ExS-5 | $2 \times 10^{-4}$ |
| Gelatin | 1.0 |
| ExM-9 | 0.2 |
| ExY-14 | 0.03 |
| ExM-8 | 0.03 |
| Solv-1 | 0.5 |

8th Layer: Second Green-sensitive Emulsion Layer

| | |
|---|---|
| Silver iodobromide emulsion (AgI content = 4 mole %; a type in which AgI content is high inside thereof; diameter corresponding to sphere = 0.6μ, coefficient of variation thereof = 38%; mixed grains of regular crystals and twin crystals; diameter/thickness ratio = 4) | 0.4 (Ag) |
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.01 |
| Solv-1 | 0.2 |

9th Layer: Third Green-sensitive Emulsion Layer

| | |
|---|---|
| Silver iodobromide emulsion (AgI content = 6 mole %; a type in which AgI content is high inside thereof; diameter corresponding to sphere = 1.0μ, coefficient of variation thereof = 80%; mixed grains of regular crystals and twin crystals; diameter/thickness ratio = 1.2) | 0.85 (Ag) |
| Gelatin | 1.0 |
| ExS-7 | $3.5 \times 10^{-4}$ |

-continued

| | |
|---|---|
| ExS-8 | $1.4 \times 10^{-4}$ |
| ExM-11 | 0.01 |
| ExM-12 | 0.03 |
| ExM-13 | 0.20 |
| ExM-8 | 0.02 |
| ExY-15 | 0.02 |
| Solv-1 | 0.20 |
| Solv-2 | 0.05 |

10th Layer: Yellow Filter Layer

| | |
|---|---|
| Gelatin | 1.2 |
| Yellow colloidal silver | 0.08 |
| Cpd-2 | 0.1 |
| Solv-1 | 0.3 |

11th Layer: First Blue-sensitive Emulsion Layer

| | |
|---|---|
| Silver iodobromide emulsion (AgI content = 4 mole %; a type in which AgI content is high inside thereof; diameter corresponding to sphere = 0.5μ, coefficient of variation thereof = 15%; octahedral grains) | 0.4 (Ag) |
| Gelatin | 1.0 |
| ExS-9 | $2 \times 10^{-4}$ |
| ExY-16 | 0.9 |
| ExY-14 | 0.07 |
| Solv-1 | 0.2 |

12th Layer: Second Blue-sensitive Emulsion Layer

| | |
|---|---|
| Silver iodobromide emulsion (AgI content = 10 mole %; a type in which AgI content is high inside thereof; diameter corresponding to sphere = 1.3μ, coefficient of variation thereof = 25%; mixed grains of regular crystals and twin crystals; diameter/thickness ratio = 4.5) | 0.5 (Ag) |
| Gelatin | 0.6 |
| ExS-9 | $1 \times 10^{-4}$ |
| ExY-16 | 0.25 |
| Solv-1 | 0.07 |

13rh Layer: First Protective Layer

| | |
|---|---|
| Gelatin | 0.8 |
| UV-1 | 0.1 |
| UV-2 | 0.2 |
| Solv-1 | 0.01 |
| Solv-2 | 0.01 |

14th Layer: Second Protective Layer

| | |
|---|---|
| Silver bromide of fine grain (average grain size = 0.07μ) | 0.5 |
| Gelatin | 0.45 |
| Polymethylmethacrylate Particles (diameter = 1.5μ) | 0.2 |
| H-1 | 0.4 |
| Cpd-3 | 0.5 |
| Cpd-4 | 0.5 |

To each layers, there were added a surfactant as an auxiliary agent for coating, in addition to the foregoing components. The sample thus obtained was referred to as Sample 101.

The structural formula or chemical name of each compound used in this Example is as follows:

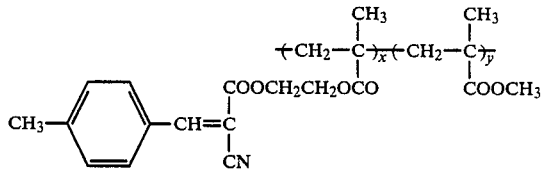

x/y = 7/3 (weight ratio)

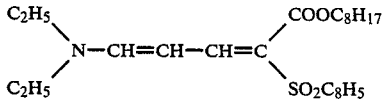

Solv-1 Trecredyl Phosphate
Solv-2 Dibutyl Phthalate
Solv-3 Bis(2-ethylhexyl) phthalate ExM-8

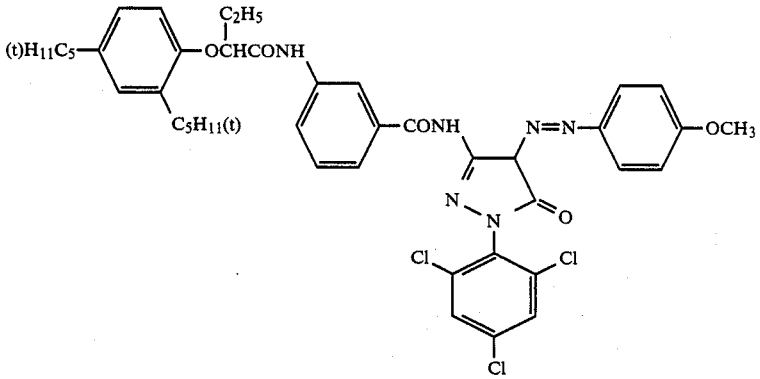

ExF-1

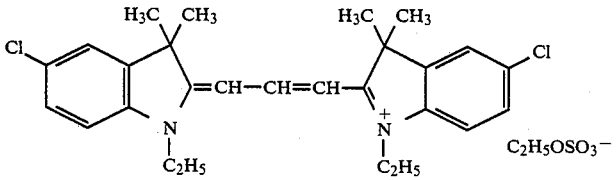

-continued
ExC-2
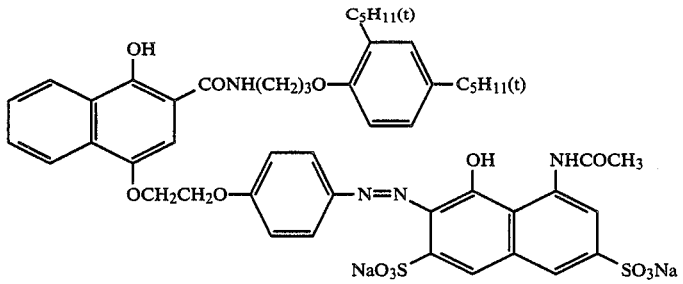
ExC-3
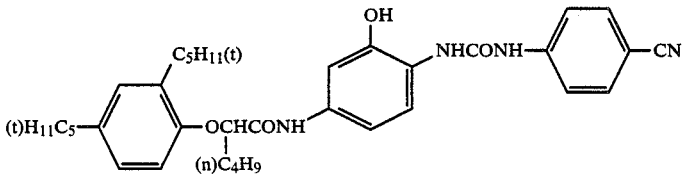
ExC-4
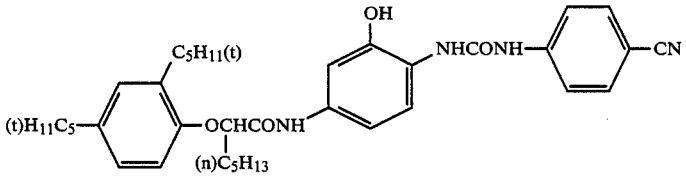
ExY-14
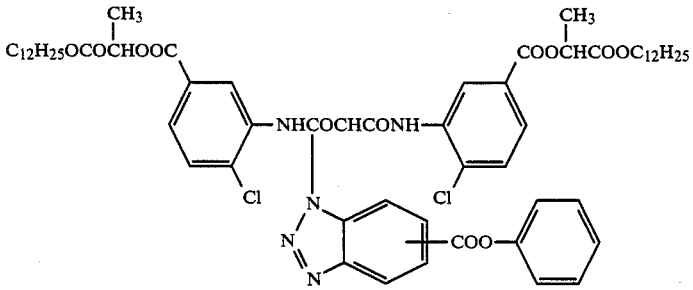
ExY-15
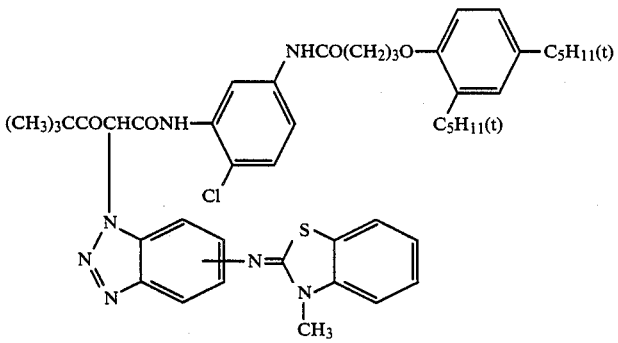

-continued
ExC-5
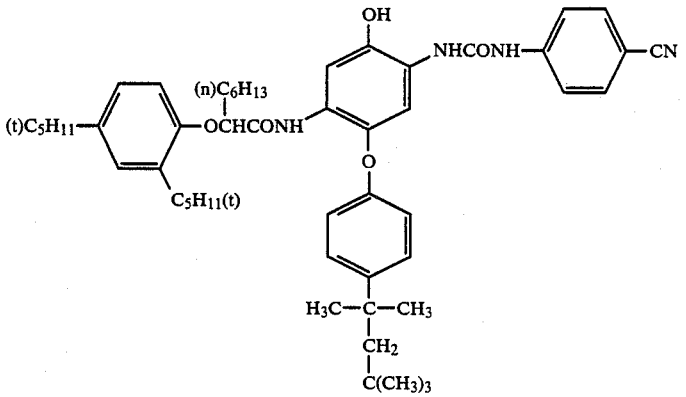
ExC-6
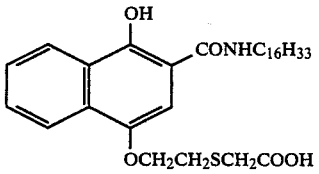
ExC-7
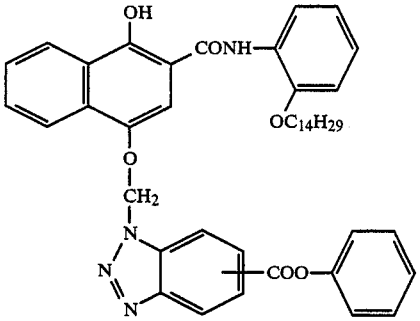
ExM-9
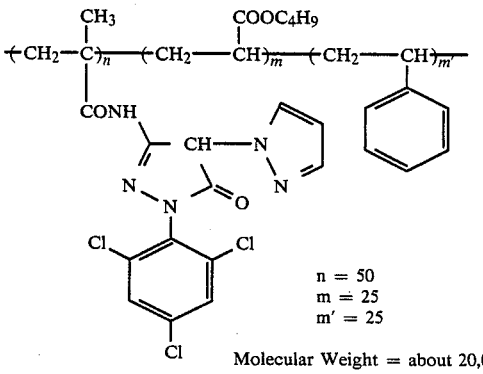
ExM-10
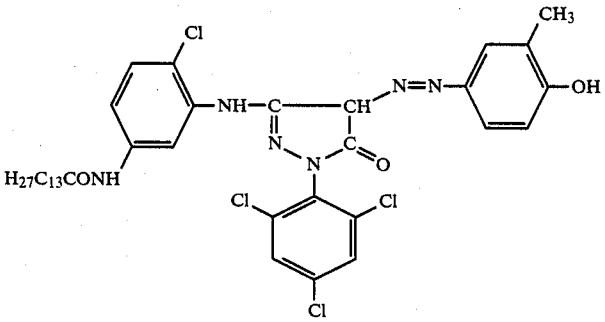

-continued
ExM-11
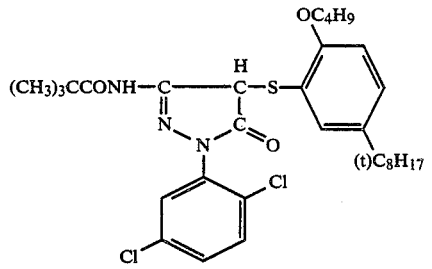
ExM-12
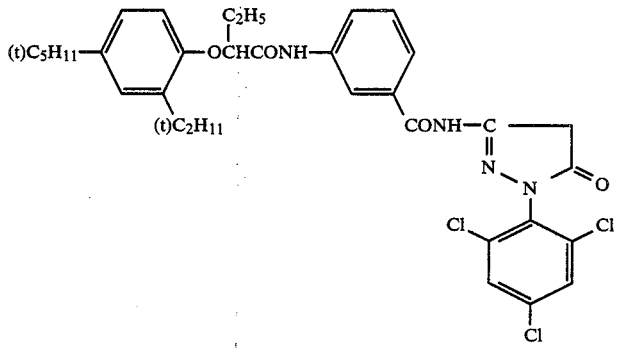
ExM-13
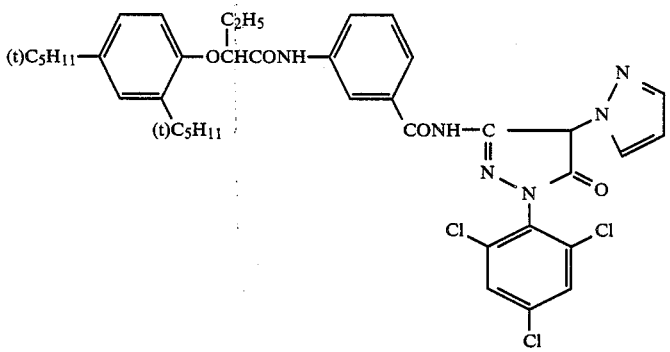
ExY-16
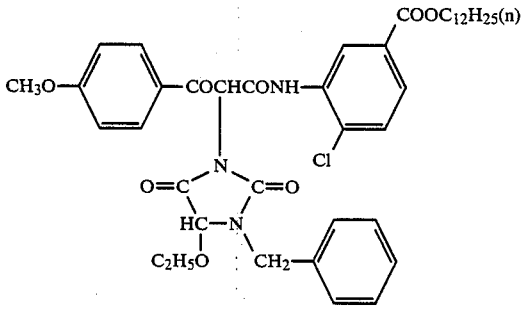
Cpd-1
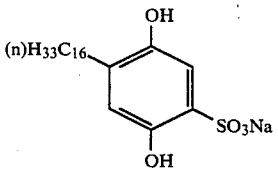
Cpd-2
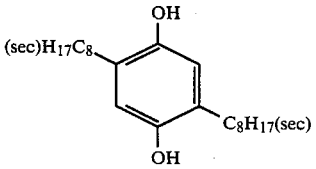

-continued
ExS-1
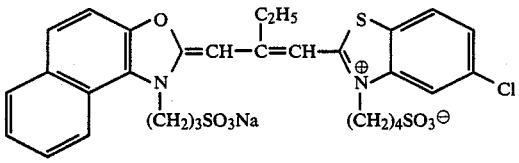
ExS-2
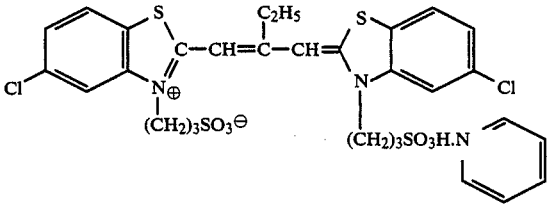
ExS-3
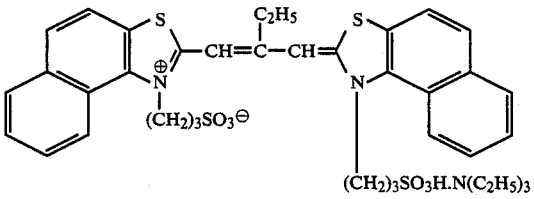
ExS-4
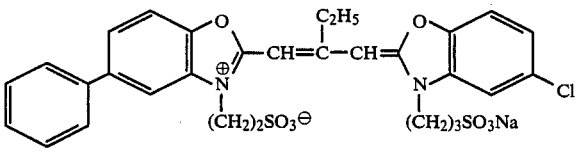
ExS-5
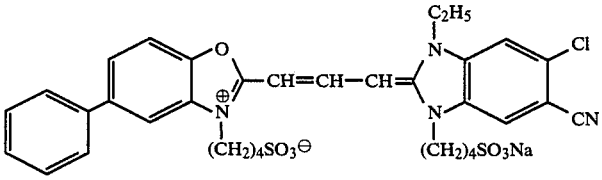
ExS-7
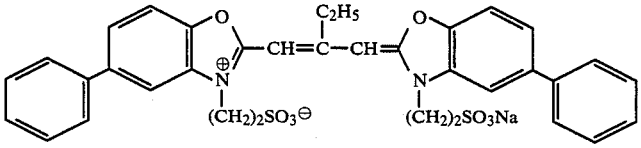
ExS-8
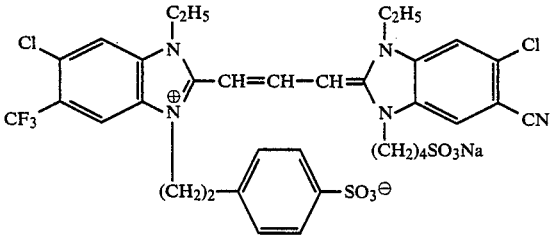
ExS-9
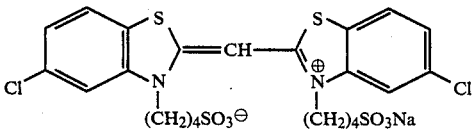
H-1
$CH_2{=}CH{-}SO_2{-}CH_2{-}CONH{-}CH_2$
$CH_2{=}CH{-}SO_2{-}CH_2{-}CONH{-}CH_2$ -continued

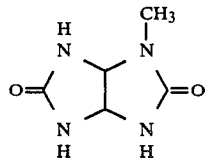

Cpd-3

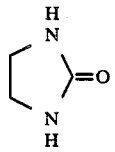

Cpd-4

After the sample was cut into band-like films of 35 mm wide and then photographed, the sample was processed according to the steps listed in Table III at a rate of 30 films/day for 4 weeks (practical operation time=22 days), utilizing the same Washing Water I to IV as in Example 1.

As to the processing in which Washing Water III was used, the processing was also effected utilizing the tank solution and replenisher for bleaching-fixing solution prepared by using Washing Water III.

TABLE III

| Steps | Processing Time (sec.) | Processing Temp. (°C.) | Amount of Replenisher (ml)* | | Tank Volume (l) |
|---|---|---|---|---|---|
| Color Development | 150 | 40 | 10 | | 8 |
| Bleaching-Fixing | 180 | 40 | 10 | Whole of the overflow from Water Washing (1) was introduced. | 8 |
| Water Washing (1) | 20 | 35 | countercurrent piping system from (2) to (1) | | |
| Water Washing (2) | 20 | 35 | 10 | | 2 |
| Stabilization | 20 | 35 | 10 | | 2 |
| Drying | 50 | 65 | | | |

*This is the amount per unit length (1 m) of the processed lightsensitive material (35 mm wide).

In these processings, an improved NEGA PROCESSOR FP-350 for CHAMPION 23S (available from Fuji Photo Film Co., Ltd.) was used. In this processor, the amount of the bleaching-fixing solution carried over, to the water washing process, by the processed material was 2 ml per unit length (1 m) thereof (35 mm wide).

The composition of each processing solution was as follows:

(Color Development Solution)

| Component | Tank Solution (g) | Replenisher (g) |
|---|---|---|
| Diethylenetriaminepentaacetic acid | 2.0 | 2.2 |
| 1-Hydroxyethylidene-1,1-diphosphonic acid | 3.0 | 3.2 |
| Sodium sulfite | 4.0 | 5.5 |
| Potassium carbonate | 30.0 | 45.0 |
| Potassium bromide | 1.4 | — |
| Potassium iodide | 1.5 (mg) | |
| Hydroxyethylamine sulfate | 2.4 | 3.0 |
| 4-(N—Ethyl-N—β-hydroxyethylamino)-2-methylaniline sulfate | 4.5 | 7.5 |
| Water | to 1.0 (l) | 1.0 (l) |
| pH | 10.05 | 10.20 |

(Bleaching-Fixing Solution)

| Component | Tank Solution (g) | Replenisher (g) |
|---|---|---|
| Ferric ammonium ethylenediaminetetraacetate dihydrate | 80.0 | 160.0 |
| Disodium ethylenediaminetetraacetate | 5.0 | 10.0 |
| Sodium sulfite | 12.0 | 24.0 |
| Ammonium thiosulfate (70% aqueous solution) | 25.0 | 500.0 |
| Acetic acid (98%) | 2.0 (ml) | 5.0 (ml) |
| Bleaching accelerator: 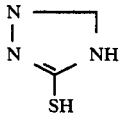 | 0.01 (mole) | 0.02 (moles) |
| Water | to 1.0 (l) | 1.0 (l) |
| pH | 6.5 | 6.4 |

(Stabilization Solution): Tank Solution and Replenisher

| Component | Amount (g) |
|---|---|
| Formalin (37%) | 2.0 (ml) |
| Polyoxyethylene p-monononylphonyl ether (average degree of polymerization = 10) | 0.3 |
| Disodium ethylenediaminetetraacetate | 0.05 |
| Water | 1.0 (l) |
| pH | 5.0–8.0 |

After the completion of 4-week processing, the proliferation of bacteria and/or mold in each water washing bath, the contamination of the processed film, the contamination of conveyor roller and the formation of deposits thereon as well as the amount of residual silver of sample 101, after processing, which was exposed to light of 100 CMS at 4800° K. were examined and the results observed were summarized in Table IV below.

TABLE IV

| | Washing Water | Bacteria, Mold in Water Washing Bath | Contamination, Deposites on Conveyor Roller | Amount of Residual Silver ($\mu g/cm^2$) | Contamination of Processed Film |
|---|---|---|---|---|---|
| Comp. Ex. | I | ++ | ++ | 4.7 | ++ |
| Comp. Ex. | II | + | ++ | 4.5 | + |
| Present Invention | III | – | – | 1.9 | – |
| Present Invention | IV | – | – | 2.0 | – |
| Present Invention* | III | – | – | 0.7 | – |

*In this processing, the bleaching-fixing solution (tank solution and replenisher) was also prepared by using Washing Water III (deionized water).

As seen from the results listed in Table IV, the method of this invention exhibits excellent effects as in Example 1 and good desilvering performance of the bleaching-fixing solution is maintained during processing.

EXAMPLE 3

There was prepared a multilayered color lightsensitive material 201 by applying, in order, the following layers, each of which had the following composition given below, on a substrate of cellulose triacetate film provided with an underlying coating.

(Composition of the Lightsensitive Layer)

In the following composition, the amount of each component was represented by coated amount expressed as $g/m^2$, while the coated amount of silver halide was represented by as amount of elemental silver calculated, provided that the coated amount of sensitizing dye was represented as molar amount per unit mole of silver halide included in the same layer.

1st Layer: Antihalation Layer

| | |
|---|---|
| Black colloidal silver | 0.2 |
| Gelatin | 2.6 |
| Cpd-3 | 0.2 |
| Solv-1 | 0.02 |

2nd Layer: Intermediate Layer

| | |
|---|---|
| Silver bromide of fine grain (average grain size = 0.07μ) | 0.15 |
| Gelatin | 1.0 |

3rd Layer: Low Sensitive Red-sensitive Emulsion Layer

| | |
|---|---|
| Monodisperse silver iodobromide (AgI content = 5.5 mole %, average grain size = 0.3μ, coefficient variation thereof (C.V.) = 19%) | 1.5 (Ag) |
| Gelatin | 3.0 |
| ExS-1 | $2.0 \times 10^{-4}$ |
| ExS-2 | $1.0 \times 10^{-4}$ |
| ExS-3 | $0.3 \times 10^{-4}$ |
| ExC-1 | 0.7 |
| ExC-2 | 0.1 |
| ExC-3 | 0.02 |
| Cpd-1 | 0.01 |
| Solv-1 | 0.8 |

-continued

| | |
|---|---|
| Solv-2 | 0.2 |
| Solv-4 | 0.1 |

4th Layer: Highly Sensitive Red-sensitive Emulsion Layer

| | |
|---|---|
| Monodisperse silver iodobromide emulsion (AgI content = 3.5 mole %; average grain size = 0.7μ, C.V. = 18%) | 1.2 (Ag) |
| Gelatin | 2.5 |
| ExS-1 | $3 \times 10^{-4}$ |
| ExS-2 | $1.5 \times 10^{-4}$ |
| ExS-3 | $0.45 \times 10^{-4}$ |
| ExC-4 | 0.15 |
| ExC-5 | 0.05 |
| ExC-2 | 0.03 |
| ExC-3 | 0.01 |
| Solv-1 | 0.05 |
| Solv-2 | 0.3 |

5th Layer: Intermediate Layer

| | |
|---|---|
| Gelatin | 0.8 |
| Cpd-2 | 0.05 |
| Solv-3 | 0.01 |

6th Layer: Low Sensitive Green-sensitive Emulsion Layer

| | |
|---|---|
| Monodisperse silver iodobromide emulsion (AgI content = 5 mole %; average grain size = 0.03μ; C.V. = 19%) | 0.4 (Ag) |
| Monodisperse silver iodobromide emulsion (AgI content = 7 mole %; average grain size = 0.5μ) | 0.8 (Ag) |
| Gelatin | 3.0 |
| ExS-4 | $1 \times 10^{-4}$ |
| ExS-5 | $4 \times 10^{-4}$ |
| ExS-6 | $1 \times 10^{-4}$ |
| ExM-6 | 0.2 |
| ExM-7 | 0.4 |
| ExM-8 | 0.16 |
| ExC-9 | 0.05 |
| Solv-2 | 1.2 |
| Solv-4 | 0.05 |
| Solv-5 | 0.01 |

7th Layer: Highly Sensitive Green-sensitive Emulsion Layer

| | |
|---|---|
| Polydisperse silver iodobromide emulsion (AgI content = 3.5 mole %; | 0.9 (Ag) |

-continued

| | |
|---|---|
| average grain size = 0.8μ; C.V. = 15% | |
| Gelatin | 1.6 |
| ExS-4 | $0.7 \times 10^{-4}$ |
| ExS-5 | $2.8 \times 10^{-4}$ |
| ExS-6 | $0.7 \times 10^{-4}$ |
| ExM-7 | 0.05 |
| ExM-8 | 0.04 |
| ExC-9 | 0.01 |
| Solv-1 | 0.08 |
| Solv-2 | 0.3 |
| Solv-4 | 0.03 |

8th Layer: Yellow Filter Layer

| | |
|---|---|
| Yellow colloidal silver | 0.2 |
| Gelatin | 0.9 |
| Cpd-2 | 0.2 |
| Solv-2 | 0.1 |

9th Layer: Low Sensitive Blue-sensitive Emulsion Layer

| | |
|---|---|
| Monodisperse silver iodobromide emulsion (AgI content = 6 mole %; average grain size = 0.3μ; C.V. = 20%) | 0.4 (Ag) |
| Monodisperse silver iodobromide emulsion (AgI content = 5 mole %; average grain size = 0.6μ; C.V. = 17%) | 0.4 (Ag) |
| Gelatin | 2.9 |
| ExS-7 | $1 \times 10^{-4}$ |
| ExS-8 | $1 \times 10^{-4}$ |
| ExY-10 | 1.2 |
| ExC-3 | 0.05 |
| Solv-2 | 0.4 |
| Solv-4 | 0.1 |

10th Layer: Highly Sensitive Blue-sensitive Emulsion Layer

| | |
|---|---|
| Monodisperse silver iodobromide emulsion (AgI content = 6 mole %; average grain size = 1.5μ; C.V. = 14%) | 0.5 (Ag) |
| Gelatin | 2.2 |
| ExS-7 | $5 \times 10^{-5}$ |
| ExS-8 | $5 \times 10^{-5}$ |
| ExY-10 | 0.4 |
| ExC-3 | 0.02 |
| Solv-2 | 0.1 |

11th Layer: First Protective Layer

| | |
|---|---|
| Gelatin | 1.0 |
| Cpd-3 | 0.1 |
| Cpd-4 | 0.1 |
| Cpd-5 | 0.1 |
| Cpd-6 | 0.1 |
| Solv-1 | 0.1 |
| Solv-4 | 0.1 |

12th Layer: Second Protective Layer

| | |
|---|---|
| Fine grain silver bromide emulsion (average grain size = 0.07μ) | 0.25 (Ag) |
| Gelatin | 1.0 |
| Polymethyl methacrylate particle (diameter = 1.5μ) | 0.2 |
| Cpd-8 | 0.5 |

In Addition to the aforementioned components, to each layers there were added a surfactant Cpd-7 and a hardening agent H-1.

The structural formulas of the compounds used in this example are as follows:

ExS-1

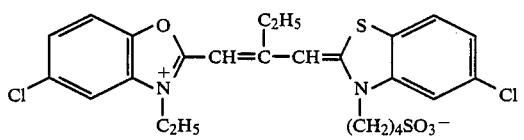

ExS-2

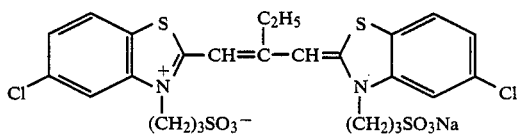

ExS-3

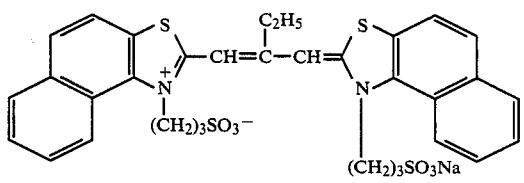

ExS-4

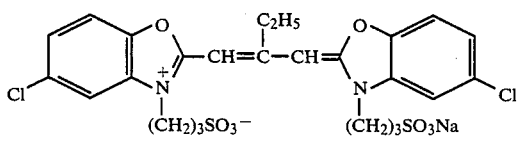

-continued
ExS-5
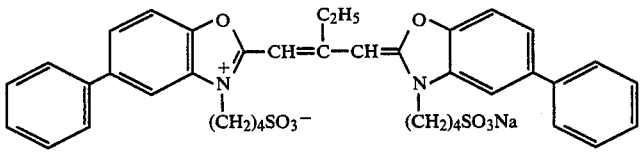
ExS-6
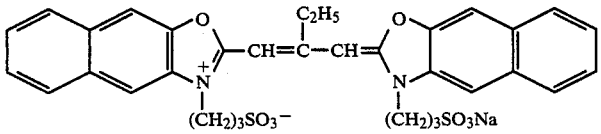
ExS-7
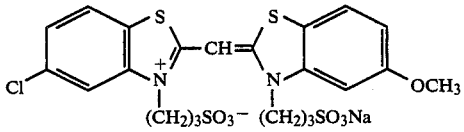
ExS-8
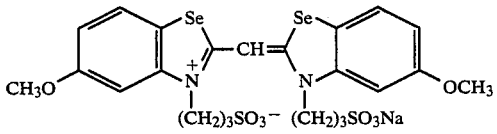
ExC-4
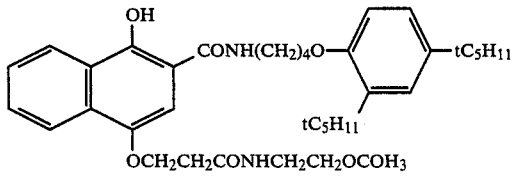
ExC-5
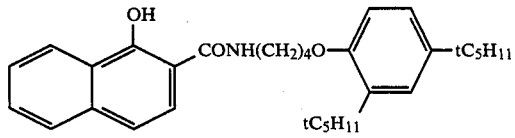
ExC-1
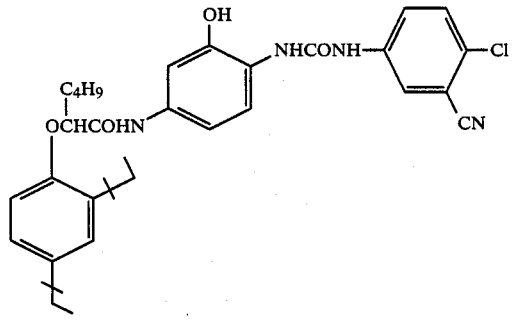

-continued
ExC-2
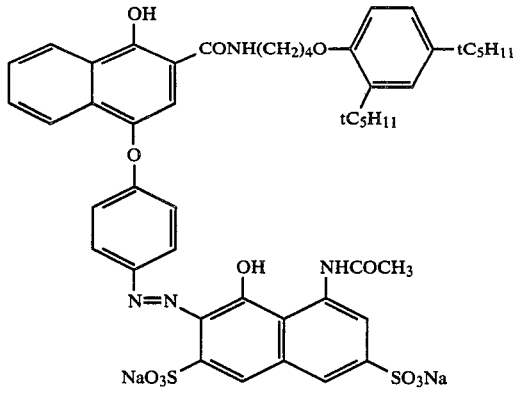
ExM-6
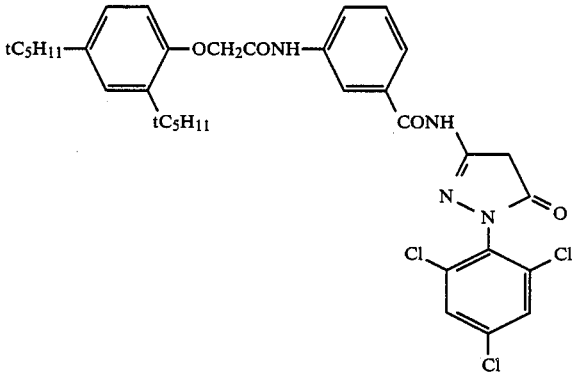
ExM-7
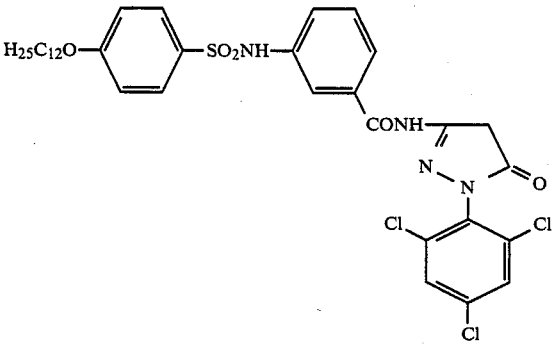
ExM-8
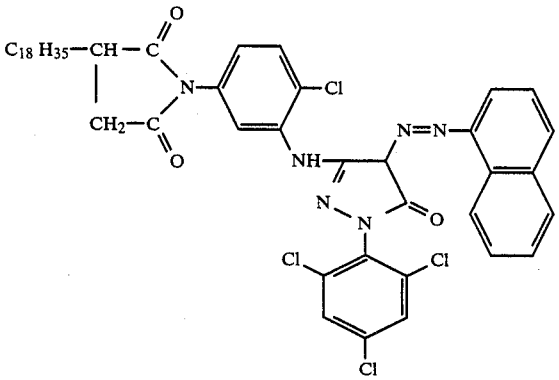

-continued
ExY-10
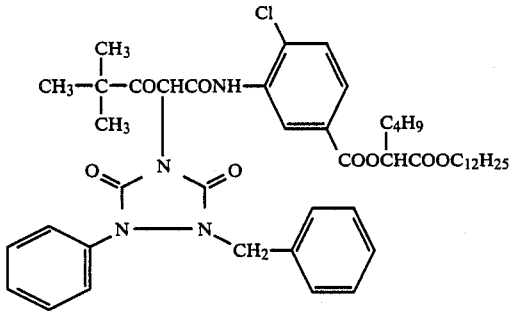
ExC-3
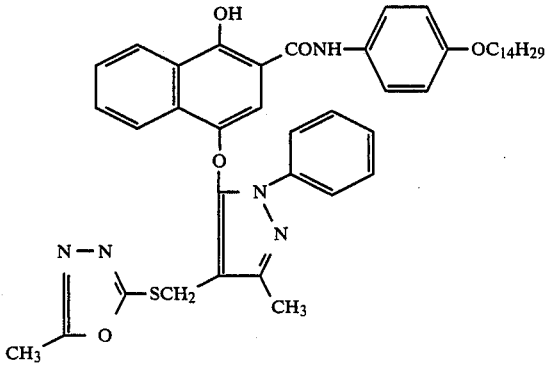
ExC-9
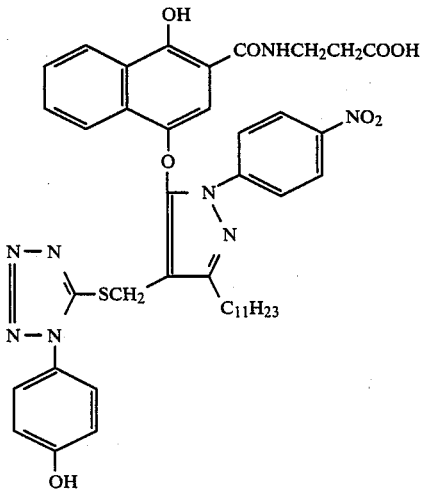
Cpd-1
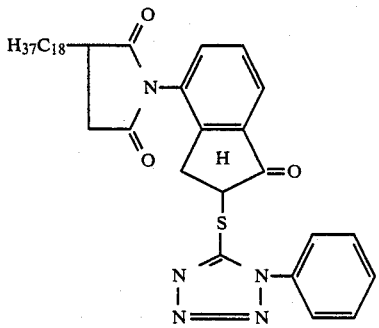

-continued
Cpd-2
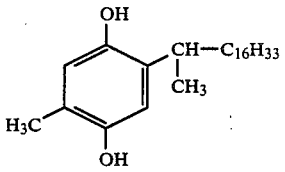
Cpd-3
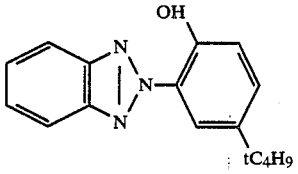
Cpd-4
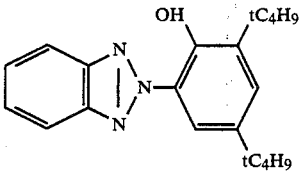
Cpd-5
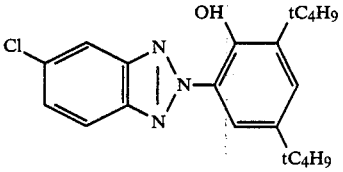
Cpd-6
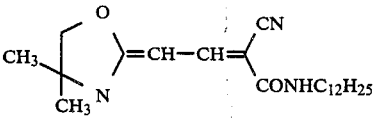
Solv-1
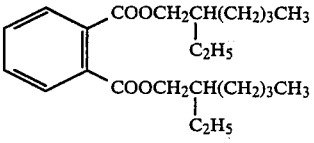
Solv-2
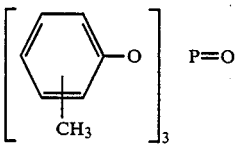
Solv-3
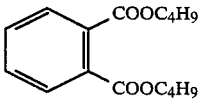
Solv-4
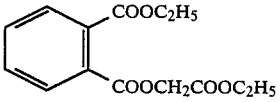
Solv-5
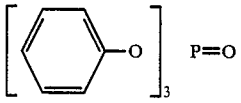
Cpd-7
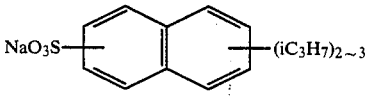

-continued

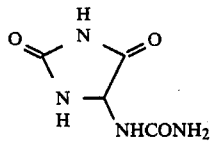

Cpd-8

$CH_2{=}CH{-}SO_2{-}CH_2$
$CH_2{=}CH{-}SO_2{-}CH_2$

H-1

Utilizing Sample 201, the same procedures as in Example 2 were repeated except for the following points shown in Table V-1.

In the processing wherein the stabilization solutions II and III were used, good results were obtained for all the properties examined, i.e., the proliferation of bacteria and/or mold, the contamination of conveyor rollers or the like and the formation of deposits thereon. The contamination of the processed film were certainly prevented and the amount of residual silver was extremely low, as compared with Comparative Tests. The results obtained are summarized in Table V-2.

TABLE V-1

| Steps | Processing Time (sec.) | Processing Temp. (°C.) | Amount of Replenisher (ml)* | | Tank Volume (l) |
|---|---|---|---|---|---|
| Color Development | 195 | 37.8 | 40 | | 10 |
| Bleaching | 180 | 37.8 | 5 | | 10 |
| Fixing | 240 | 37.8 | 10 | Whole of the overflow from the stabilization (1) was introduced | 10 |
| Stabilization (1) | 45 | 35.0 | Countercurrent Piping | | 5 |
| Stabilization (2) | 45 | 35.0 | System from (3) to (1) | | 5 |
| Stabilization (3) | 45 | 35.0 | 10 | | 5 |
| Drying | 80 | 55.0 | | | |

*This is the amount per unit length (1 m) of the processed lightsensitive material (35 mm wide).

The composition of each processing solution was as follows:

(Color Development Solution)

| Component | Tank Solution (g) | Replenisher (g) |
|---|---|---|
| Diethylene triaminepentaacetic acid | 5.0 | 6.0 |
| Sodium sulfite | 4.0 | 4.4 |
| Potassium carbonate | 30.0 | 37.0 |
| Potassium bromide | 1.3 | 0.9 |
| Potassium iodide | 1.2 mg | — |
| Hydroxylanine sulfate | 2.0 | 2.8 |
| 4-(N—Ethyl-N—β-hydroxyethylamino)-2-methylaniline sulfate | 4.7 | 5.3 |
| Water | to 1.0 (l) | 1.0 (l) |
| pH | 10.00 | 10.05 |

(Bleaching Solution)

| Component | Tank Solution (g) | Replenisher (g) |
|---|---|---|
| Ferric ammonium ethylenediaminetetraacetic dihydrate | 120.0 | 150.0 |
| Disodium ethylenediaminetetraacetate | 0.5 | 1.0 |
| Sodium sulfite | 7.0 | 16.0 |
| Sodium bisulfite | 5.0 | 11.0 |
| Ammonium thiosulfate (70% aqueous solution) | 170.0 (ml) | 400.0 (ml) |
| Water | to 1.0 (l) | 1.0 (l) |

-continued

| Component | Tank Solution (g) | Replenisher (g) |
|---|---|---|
| Ethylenediaminetetraacetic acid | 4.0 | 5.0 |
| Ammonium bromide | 100.0 | 160.0 |
| Ammonium nitrate | 30.0 | 50.0 |
| Aqueous ammonia (27%) | 20.0 (ml) | 23.0 (ml) |
| 98% Acetic acid | 9.0 (ml) | 15.0 (ml) |
| Water | to 1.0 (l) | 1.0 (l) |
| pH | 5.5 | 4.5 |

(Fixing Solution)

| Component | Tank Solution (g) | Replenisher (g) |
|---|---|---|

-continued

| Component | Tank Solution (g) | Replenisher (g) |
|---|---|---|
| pH | 6.7 | 6.6 |

(Stabilization Solution): Tank Solution and Relenisher

Stabilization Solution I:

| Component | Amount (g) |
|---|---|
| Tap water* | 800 (ml) |
| Formalin (37%) | 1.2 (ml) |
| 5-Chloro-2-methyl-4-isothiazolin-3-one | 6.0 (mg) |
| 2-Methyl-4-isothiazolin-3-one | 3.0 (mg) |
| Surfactant [$C_{10}H_{21}$—O—$(CH_2CH_2O)_{10}$—H] | 0.4 |
| Ethylene glycol | 1.0 |
| Tap water* | to 1.0 (l) |
| pH | 5.0–7.0 |

*The properties of this tap water were the same as those of the washing water I.

Stabilization Solution II: This was prepared according in the same manner as that for preparing Stabilization Solution I except that the tap water in Stabilization Solution I was replaced with Washing Water III in Example 1 (deionized water).

Stabliziation Solution III: This was prepared by adding 0.2 g/l of ammonium sulfate to the stabilization solution II. pH thereof was 6.1.

TABLE V-2

| | Stabilization Solution | Bacteria, Mold in Water Washing Bath | Contamination, Deposits on Conveyor Rollers | Amount of Residual Silver | Contamination of Processed Film | Adhesion Properties |
|---|---|---|---|---|---|---|
| Comp. Test | I | ++ | ++ | 4.8 | ++ | x |
| Present Invention | II | — | — | 1.8 | — | o |
| Present Invention | III | — | — | 1.4 | — | ⊙ |

After running treatments utilizing the aforementioned stabilization solutions, the estimation of the adhesion properties of the processed film was effected as follows. In this connection, the temperature during the running treatments was in the range of from 25° to 33° C. which was quite favourable for the growth of bacteria and mold.

After the running treatment, the sample which had been imagewise exposed to light was cut into pieces of 8.25 cm×11.7 cm and adhesion test was conducted using every 10 pieces thereof.

The adhesion test was effected by maintaining the sample within a room held at 35° C. and RH 80%, bringing the emulsion layers of every two of the 10 photographic paper into contact with each other, superposing these pairs on a plate, placing thereon, a plate having the same size as that of the photographic paper (plate made of vinyl chloride resin; 1 cm thick), loading a weigh of 5 kg, then allowing the photographic paper to stand under such condition and peeling off every two superposed paper to estimate the adhesiveness visually on the basis of the conditions of surfaces observed.

The results given in Table V-2 shown above were obtained based on the following standard:

⊙ : no adhesion mark o: almost no marks of adhesion;

Δ: there was observed marks of adhesion not more than ⅓ of the total surface area;

x: there was observed marks of adhesion more than ⅓ of the total surface area.

EXAMPLE 4

The sample prepared in Example 1 was subjected to development except that the following washing water was used in this Example and the proliferation of mold in each water washing bath, the contamination of paper and the like were examined.

Washing Water V: Tank Solution and Replenisher

This was prepared by passing tap water through a mixed bed type column packed with an H-type strong acidic cation exchange resin (available from Rohm & Haas Co. under the trade name of Amberlite IR-120B) and an OH-type anion exchange resin (available from the same company under the trade name of Amberlite IR-400) and then adding, to the water thus treated, the following compounds:

| | |
|---|---|
| Sodium chlorinated isocyanurate | 20 mg/l |
| Anhydrous sodium sulfate | 130 mg/l |
| Ammonium chloride | 2 g/l |

Properties thereof were as follows:

| | |
|---|---|
| Ca | 0.3 mg/l |
| Mg | ≦0.1 mg/l |
| pH (NaOH) | 6.5 |

The results obtained are summarized in Table VI given below. In Table VI, the adhesion properties were determined according in the same manner as in Example 3.

TABLE VI

| Bacteria, Mold in Water Washing Bath | Contamination of Processed Paper | Contamination, Deposits on Conveyor Roller | Adhesion Properties |
|---|---|---|---|
| — | — | — | ⊙ |

As seen from the results listed in Table VI, good results on the whole properties examined are obtained according to the method of this invention, i.e., the proliferation of bacteria and/or mold, contamination of paper with mold and deposition of mold thereon, contamination of conveyor rollers or formation of deposits thereon were surely prevented and the improvement in the adhesion properties was achieved.

EXAMPLE 5

The same procedures as in Example 2 were repeated except that the color lightsensitive material in Example 2 was replaced with the following color lightsensitive materials A or B and substantially the same results were obtained.

(Color Lightsensitive Material A)

A multilayered color lightsensitive material was prepared by applying, in order, the following layers, each of which had the following composition given below, on a substrate of cellulose triacetate film provided with an underlying coating.

(Composition of the Lightsensitive Layer)

In the following composition, the amount of silver halide and colloidal silver is represented by coated amount expressed as $g/m^2$, the amount of coupler, additives and gelatin is represented by coated amount expressed as $g/m^2$, and the amount of sensitizing dye is represented by coated amount expressed as molar amount per unit mole of silver halide included in the same layer.

1st Layer: Antihalation Layer

| | |
|---|---|
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |

2nd Layer: Intermediate Layer

| | |
|---|---|
| Gelatin | 1.0 |
| UV-1 | 0.03 |
| ExC-4 | 0.02 |
| ExF-1 | 0.004 |
| Solv-1 | 0.1 |
| Solv-2 | 0.1 |

3rd Layer: Low Sensitive Red-sensitive Emulsion Layer

| | |
|---|---|
| Silver iodobromide emulsion (AgI content = 4 mole %; uniform AgI type; diameter corresponding to sphere = 0.5 μ, C.V. thereof = 20%; plate-like grain; diameter/thickness ratio = 3.0) | 1.2 (Ag) |
| Silver iodobromide emulsion (AgI content = 3 mole %; uniform AgI type; diameter corresponding to sphere = 0.3 μ, C.V. thereof = 15%; spherical grain; diameter/thickness ratio = 1.0) | 0.6 (Ag) |
| Gelatin | 1.0 |
| ExS-1 | $4 \times 10^{-4}$ |
| ExS-2 | $5 \times 10^{-5}$ |
| ExC-1 | 0.05 |
| ExC-2 | 0.50 |
| ExC-3 | 0.03 |
| ExC-4 | 0.12 |
| ExC-5 | 0.01 |

4th Layer: Highly Sensitive Red-sensitive Emulsion Layer

| | |
|---|---|
| Silver iodobromide emulsion (AgI content = mole %; a type in which | 0.7 (Ag) |

-continued

| | |
|---|---|
| AgI content is high inside thereof and which has a core/shell ratio of 1:1; diameter corresponding to sphere = 0.7 μ, C.V. thereof = 15%; plate-like grain; diameter/thickness ratio = 5.0) | |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |

5th Layer: Intermediate Layer

| | |
|---|---|
| Gelatin | 0.5 |
| Cpd-1 | 0.1 |
| Solv-1 | 0.05 |

6th Layer: Low Sensitive Green-sensitive Emulsion Layer

| | |
|---|---|
| Silver iodobromide emulsion (AgI content = 14 mole %; a type having a core/shell ratio of 1:1, in which AgI content is high at the surface thereof; diameter corresponding to sphere = 0.5 μ, C.V. thereof = 15%; plate-like grain; diameter/thickness ratio = 4.0) | 0.35 (silver) |
| Silver iodobromide emulsion (AgI content = 3 mole %; uniform AgI type; diameter corresponding to sphere = 0.3 μ, C.V. thereof = 25%; spheric grain; diameter/thickness ratio = 1.0) | 0.20 (Ag) |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |

7th Layer: Highly Sensitive Green-sensitive Emulsion Layer

| | |
|---|---|
| Silver iodobromide emulsion (AgI content = 4 mole %; a type having a core/shell ratio of 1:3, in which AgI content is high inside thereof; diameter corresponding to sphere = 0.7μ, C.V. thereof = 20%; plate-like grain; diameter/thickness ratio = 5.0) | 0.8 (Ag) |
| Gelatin | 0.5 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |

8th Layer: Intermediate Layer

| | |
|---|---|
| Gelatin | 0.5 |
| Cpd-1 | 0.05 |

-continued

| | |
|---|---|
| Solv-1 | 0.02 |

9th Layer: Denor Layer having Interlayer Effect to Red-sensitive Layer

| | |
|---|---|
| Silver iodobromide emulsion (AgI content = 2 mole %; a type having core/shell ratio of 2:1, in which AgI content is high inside thereof; diameter corresponding to sphere = 1.0μ, C.V. thereof = 15%; plate-like grain; diameter/thickness ratio = 6.0) | 0.35 (Ag) |
| Silver iodobromide emulsion (AgI content = 2 mole %; a type having a core/shell ratio of 1:1, in which AgI content is high inside thereof; diameter corresponding to sphere = 0.4μ, C.V. thereof = 20%; plate-like grain; diameter/thickness ratio = 6.0) | 0.20 (Ag) |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |

10th Layer: Yellow Filter Layer

| | |
|---|---|
| Yellow colloidal silver | 0.05 |
| Gelatin | 0.5 |
| Cpd-2 | 0.13 |
| Solv-1 | 0.13 |
| Cpd-1 | 0.10 |

11th Layer: Low Sensitive Blue-sensitive Emulsion Layer

| | |
|---|---|
| Silver iodobromide emulsion (AgI content = 4.5 mole %; uniform AgI type; diameter corresponding to sphere = 0.7μ, C.V. thereof = 15%; plate-like grain; diameter/thickness ratio = 7.0) | 0.3 (Ag) |
| Silver iodobromide emulsion (AgI content = 3 mole %; uniform AgI type; diameter corresponding to sphere = 0.3μ, C.V. thereof = 25%; plate-like grain; diameter/thickness ratio = 7.0) | 0.15 (Ag) |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 1.0 |
| Solv-1 | 0.20 |

12th Layer: Highly Sensitive Blue-sensitive Emulsion Layer

| | |
|---|---|
| Silver iodobromide emulsion (AgI content = 10 mole %; a type in which AgI content is high inside thereof; diameter corresponding to sphere = 1.0μ, C.V. thereof = 25%; multiple twin crystalline plate-like grain; diameter/thickness ratio = 2.0) | 0.5 (Ag) |
| Gelatin | 0.5 |
| ExS-6 | $1 \times 10^{-4}$ |
| ExY-15 | 0.20 |
| ExY-13 | 0.01 |

-continued

| | |
|---|---|
| Solv-1 | 0.10 |

13th Layer: First Protective Layer

| | |
|---|---|
| Gelatin | 0.8 |
| UV-4 | 0.1 |
| UV-5 | 0.15 |
| Solv-1 | 0.01 |
| Solv-2 | 0.01 |

14th Layer: Second Protective Layer

| | |
|---|---|
| Fine grain silver iodobromide emulsion (AgI content = 2 mole %; uniform AgI type; diameter corresponding to sphere = 0.07μ) | 0.5 (Ag) |
| Gelatin | 0.45 |
| Polymethyl methacrylate particle (diameter = 1.5μ) | 0.2 |
| H-1 | 0.4 |
| Cpd-5 | 0.5 |
| Cpd-6 | 0.5 |

To each layer, there were added 0.04 g/m$^2$ of a stabilizer for emulsion Cpd-3 and 0.02 g/m$^2$ of a surfactant Cpd-4 as the coating aid in addition to the foregoing components.

(Color Lightsensitive Material B)

(Composition of the Lightsensitive Layer)

In the following composition, the amount of each component is represented by coated amount expressed as g/m$^2$ and the amount of silver halide is represented by coated amount expressed as the reduced amount of elemental silver, provided that the amount of sensitizing dye is represented by coated amount expressed as molar amount per unit mole of silver halide included in the same layer.

1st Layer: Antihalation Layer

| | |
|---|---|
| Black colloidal silver | 0.18 (Ag) |
| Gelatin | 0.40 |

2nd Layer: Intermediate Layer

| | |
|---|---|
| 2,5-di-tert-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |

3rd Layer: First Red-sensitive Emulsion Layer

| | |
|---|---|
| Monodisperse silver iodobromide emulsion (AgI content = 6 mole %; average diameter = 0.6μ, C.V. thereof = 0.15) | 0.55 (Ag) |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-2 | 0.350 |

-continued

| | |
|---|---|
| HBS-1 | 0.005 |
| EX-10 | 0.020 |
| Gelatin | 1.20 |

4th Layer: Second Red-sensitive Emulsion Layer

| | |
|---|---|
| Plate-like silver iodobromide emulsion (AgI content = 10 mole %; average grain size = 0.7μ; average aspect ratio = 5.5; average thickness = 0.2μ) | 1.0 (Ag) |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| EX-2 | 0.400 |
| EX-3 | 0.050 |
| EX-10 | 0.015 |
| Gelatin | 1.30 |

5th Layer: Third Red-sensitive Emulsion Layer

| | |
|---|---|
| Silver iodobromide emulsion (AgI content = 16 mole %; average grain size = 1.1μ) | 1.60 (Ag) |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| EX-3 | 0.240 |
| EX-4 | 0.120 |
| HBS-1 | 0.22 |
| HBS-2 | 0.10 |
| Gelatin | 1.63 |

6th Layer: Intermediate Layer

| | |
|---|---|
| EX-5 | 0.040 |
| HBS-1 | 0.020 |
| EX-12 | 0.004 |
| Gelatin | 0.80 |

7th Layer: First Green-sensitive Emulsion Layer

| | |
|---|---|
| Plate-like silver iodobromide emulsion (AgI content = 6 mole %; average grain size = 0.6μ; average aspect ratio = 6.0; average thickness = 0.15μ) | 0.40 (Ag) |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |

8th Layer: Second Green-sensitive Emulsion Layer

| | |
|---|---|
| Monodisperse silver iodobromide emulsion (AgI content = 9 mole %; average grain size = 0.7μ, C.V. thereof = 0.18) | 0.80 (Ag) |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| EX-6 | 0.180 |
| EX-8 | 0.010 |

-continued

| | |
|---|---|
| EX-1 | 0.008 |
| EX-7 | 0.012 |
| HBS-1 | 0.160 |
| HBS-4 | 0.008 |
| Gelatin | 1.10 |

9th Layer: Third Green-sensitive Emulsion Layer

| | |
|---|---|
| Silver iodobromide emulsion (AgI content = 12 mole %; average grain size = 1.0μ) | 1.2 (Ag) |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-6 | 0.065 |
| EX-11 | 0.030 |
| EX-1 | 0.025 |
| HBS-1 | 0.25 |
| HBS-2 | 0.10 |
| Gelatin | 1.74 |

10th Layer: Yellow Filter Layer

| | |
|---|---|
| Yellow colloidal silver | 0.05 (Ag) |
| EX-5 | 0.08 |
| HBS-3 | 0.03 |
| Gelatin | 0.95 |

11th Layer: First Blue-sensitive Emulsion Layer

| | |
|---|---|
| Plate-like silver iodobromide emulsion (AgI content = 6 mole %; average grain size = 0.6μ; average aspect ratio = 5.7; average thickness = 0.15μ) | 0.24 (Ag) |
| Sensitizing dye VIII | $3.5 \times 10^{-4}$ |
| EX-9 | 0.85 |
| EX-8 | 0.12 |
| HBS-1 | 0.28 |
| Gelatin | 1.28 |

12th Layer: Second Blue-sensitive Emulsion layer

| | |
|---|---|
| Monodisperse silver iodobromide emulsion (AgI content = 10 mole %; average grain size = 0.8μ, C.V. thereof = 0.16) | 0.45 (Ag) |
| Sensitizing dye VIII | $2.1 \times 10^{-4}$ |
| EX-9 | 0.20 |
| EX-10 | 0.015 |
| HBS-1 | 0.03 |
| Gelatin | 0.46 |

13th Layer: Third Blue-sensitive Emulsion Layer

| | |
|---|---|
| Silver iodobromide emulsion (AgI content = 14 mole %; average grain size = 1.3μ) | 0.77 (Ag) |
| Sensitizing dye VIII | $2.2 \times 10^{-4}$ |
| EX-9 | 0.20 |
| HBS-1 | 0.07 |
| Gelatin | 0.69 |

14th Layer: First Protective Layer

| | |
|---|---|
| Silver iodobromide emulsion (AgI content = 1 mole %; average grain size = 0.07μ) | 0.5 (Ag) |
| U-4 | 0.11 |
| U-5 | 0.17 |

-continued

| | |
|---|---|
| HBS-1 | 0.90 |
| Gelatin | 1.00 |

15th Layer: Second Protective Layer

| | |
|---|---|
| Polymethyl methacrylate particles (diameter = about 1.5μ) | 0.54 |
| S-1 | 0.15 |

-continued

| | |
|---|---|
| S-2 | 0.05 |
| Gelatin | 0.72 |

In each layer, there were incorporated an agent for hardening gelatin H-1 and a surfactant, in addition to the aforementioned components.

The structural formulas of the compounds used to form the lightsensitive materials A and B will hereunder be given.

UV-1/U-1

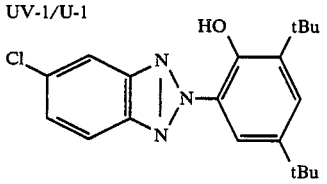

UV-2/U-2

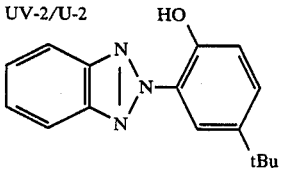

UV-3/U-3

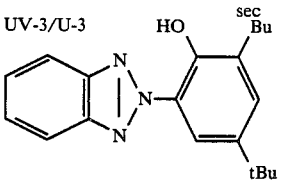

UV-4/U-4

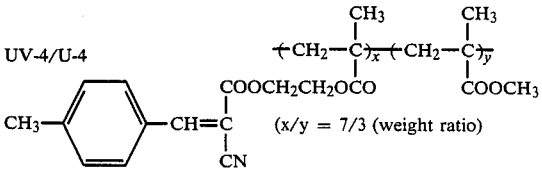

UV-5/U-5

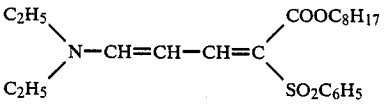

Solv-1/HBS-1 Trecredyl Phosphate

Solv-2/HBS-2 Dibutyl Phthalate

Solv-3

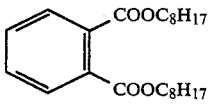

Solv-4/HBS-4

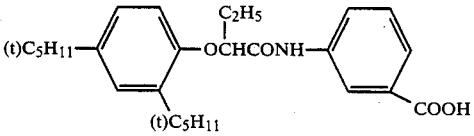

-continued
Cpd/EX-5
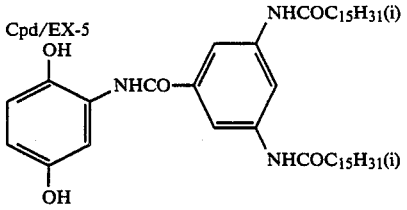
Cpd-2
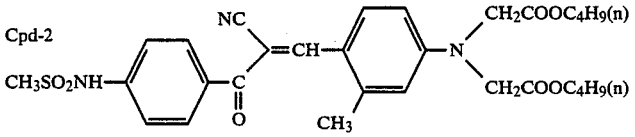
Cpd-3
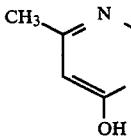
Cpd-4
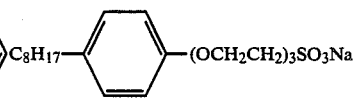
Cpd-5/S-1
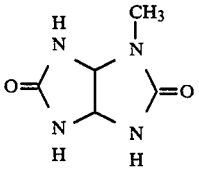
Cpd-6/S-2
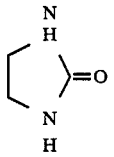
ExC-1
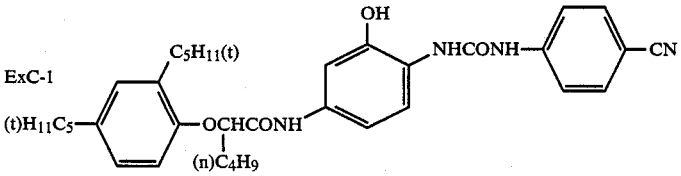
ExC-2/Ex-2
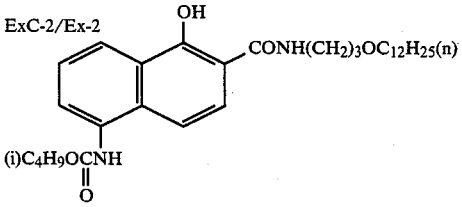
ExC-3
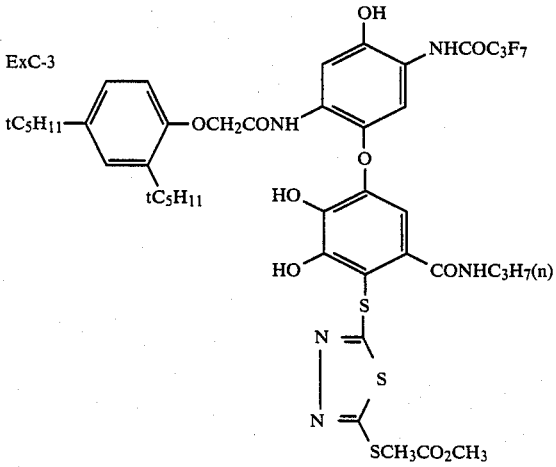

-continued
Ex-C-4/Ex-3
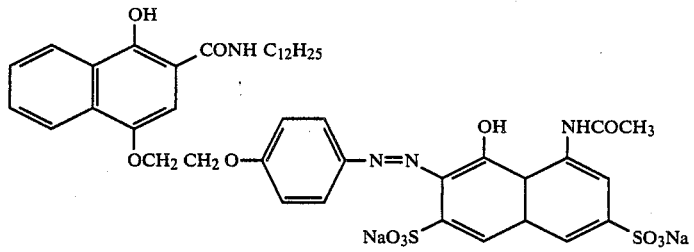
ExC-5
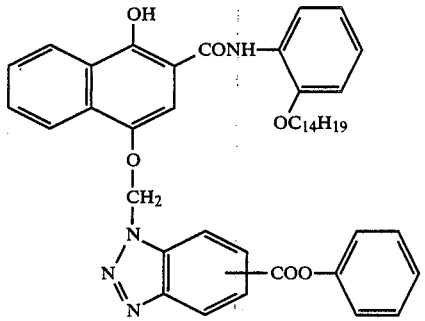
ExC-6
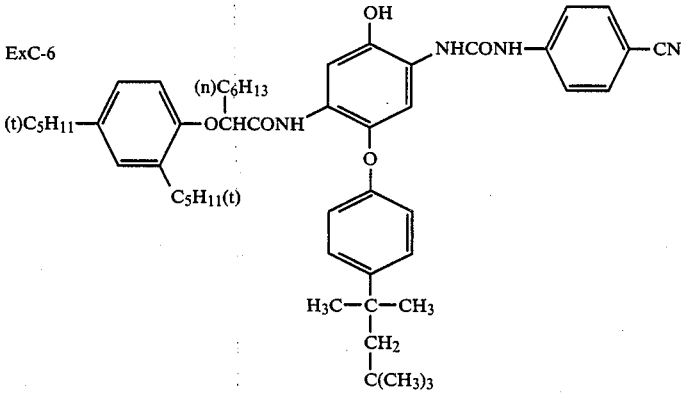
ExC-7/Ex-4
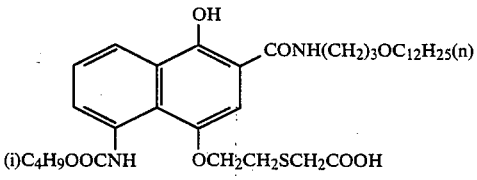
ExM-8/Ex-6
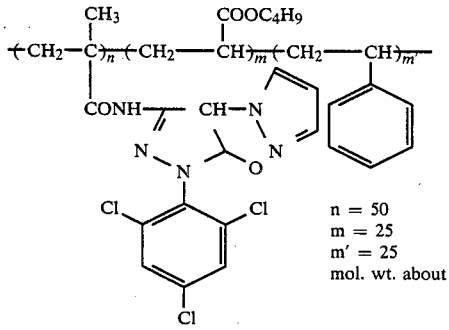
n = 50
m = 25
m′ = 25
mol. wt. about 20.000

-continued
ExM-9/Ex-1
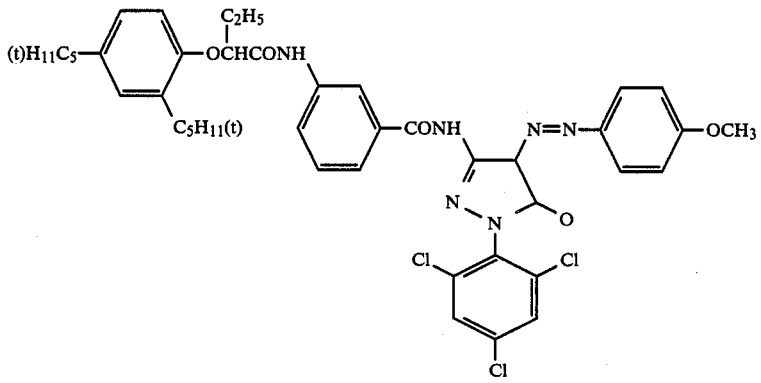
ExM-10
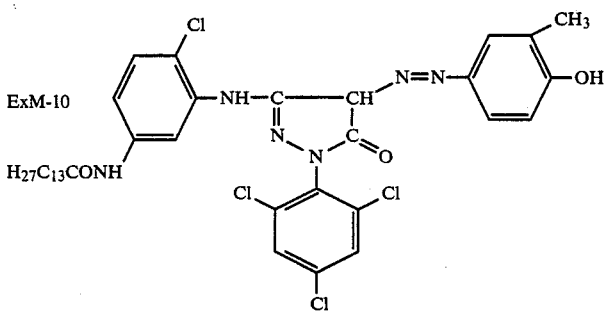
ExY-11
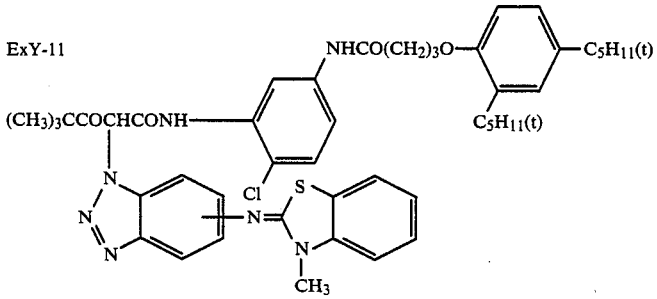
ExM-12/Ex-7
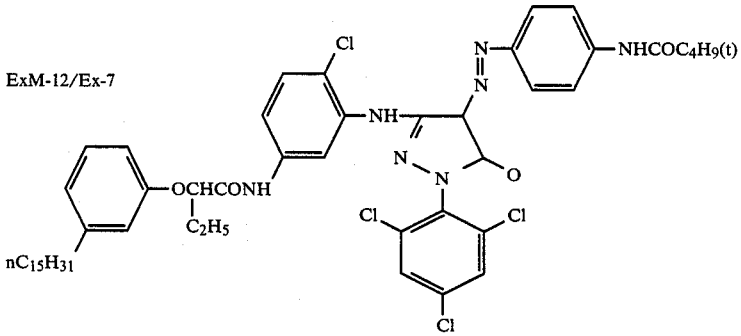

-continued
ExY-13/Ex-8
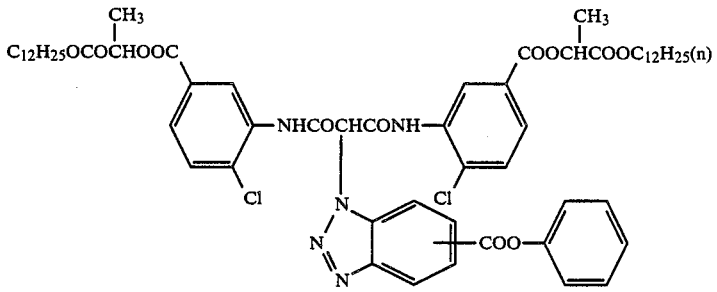
ExM-14
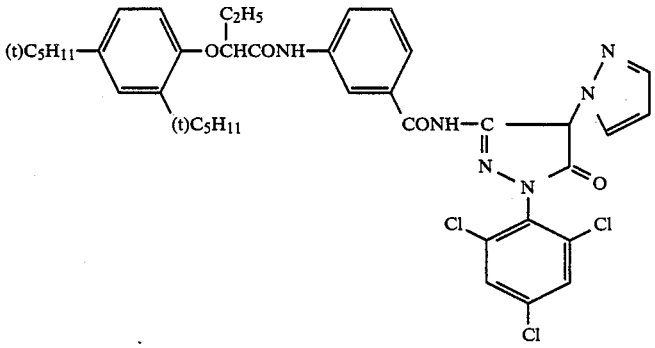
ExY-15/Ex-9
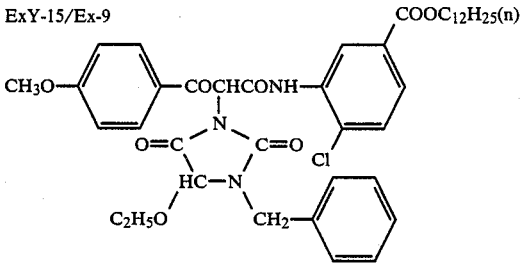
ExC-16/Ex-10
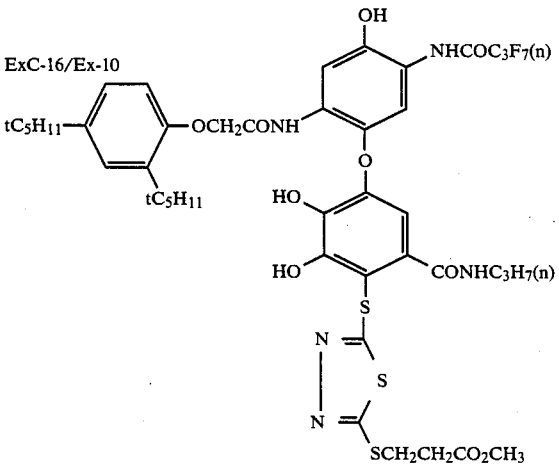
ExS-1
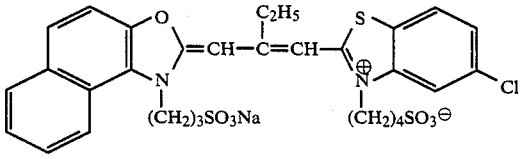

-continued
ExS-2/Sensitizing Dye III
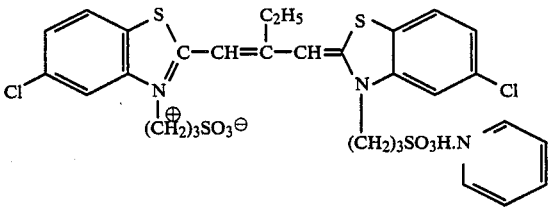
ExS-3
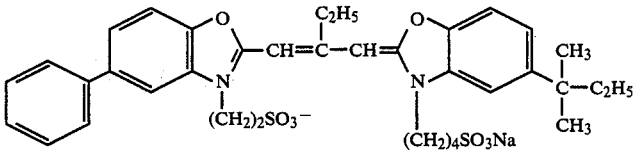
ExS-4/Sensitizing Dye VII
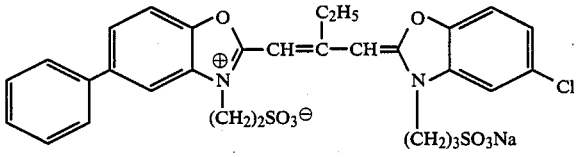
ExS-5/Sensitizing Dye V
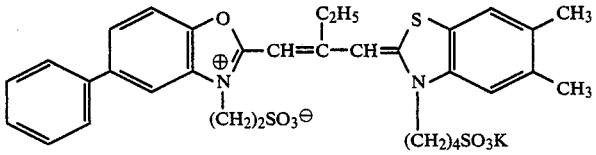
ExS-6/Sensitizing Dye VII
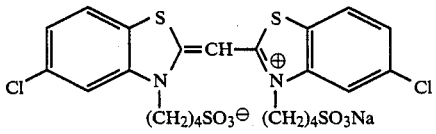
H-1
$CH_2{=}CH{-}SO_2{-}CH_2{-}CONH{-}CH_2$
$CH_2{=}CH{-}SO_2{-}CH_2{-}CONH{-}CH_2$
ExF-1/Ex-12
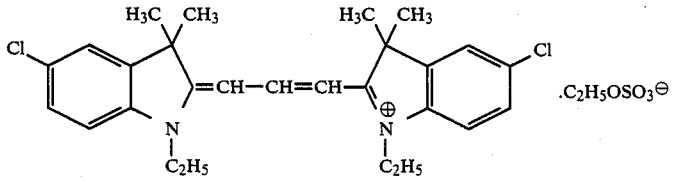

-continued

EX-//

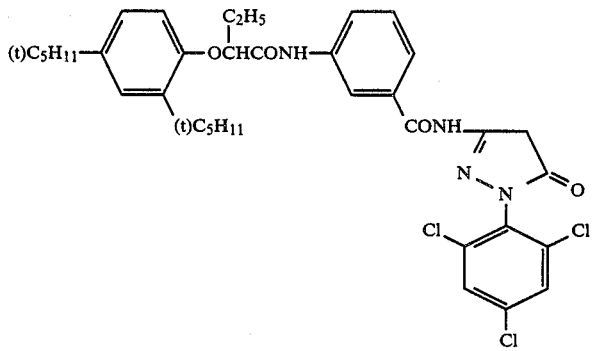

HBS-3 Bis(2-ethylhexyl)-phthalate

Sensitizing Dye

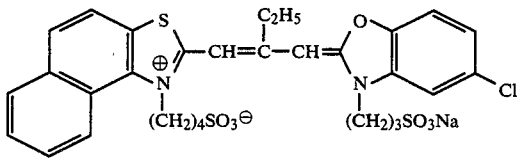

II

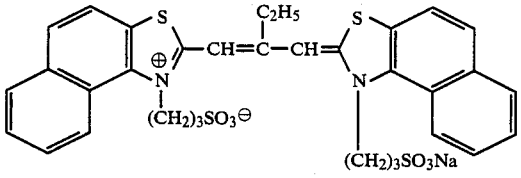

IV

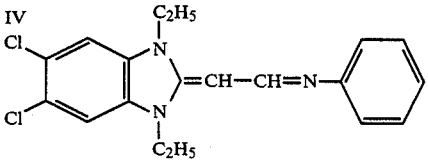

VI

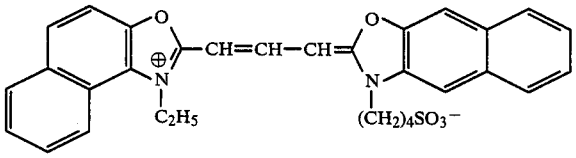

IX

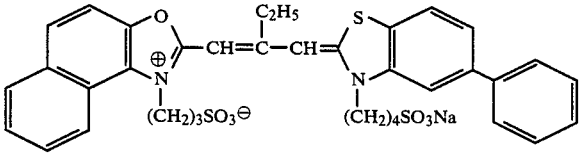

What is claimed is:

1. A method for processing silver halide photographic lightsensitive materials in which there are used replenishers for water washing and/or stabilization processes in such a manner that the concentrations of calcium and magnesium compounds in the replenishers are not more than 5 mg/l on the basis of elemental calcium and magnesium respectively, and a part or whole of overflow from the water washing and/or stabilization processes is introducing into a treating process having fixing ability and which is preceding the water washing and/or stabilization processes.

2. A method for processing according to claim 1 wherein the amount of the replenisher for the water washing and/or stabilization processes is 1 to 50 times the volume of liquid carried over, from the preceding process, by the processed lightsensitive material per unit area thereof.

3. A method for processing according to claim 1 wherein the water washing and/or stabilization processes comprise a plurality of baths and the replenishment is effected by multistage countercurrent system.

4. A method for processing according to claim 1 wherein the concentrations of calcium and magnesium compounds present in a replenisher for the fixing process just before the water washing and/or stabilization processes, is not more than 5 mg/l on the basis of elemental calcium and magnesium respectively.

5. A method for processing according to claim 1 wherein the concentrations of calcium and magnesium present in the replenisher for the water washing and/or stabilization processes are not more than 3 mg/l on the basis of elemental calcium and magnesium respectively.

6. A method for processing according to claim 1 wherein the water washing or the stabilization process is effected at 20° to 50° C. for 10 seconds to 10 minutes.

7. A method for processing according to claim 1 wherein the amount of the overflow introduced into the preceding bath is 0.2 to 5 times that of a replenisher for the preceding bath.

8. A method for processing according to claim 1 wherein the replenisher for the water washing and/or stabilization processes further contains an ammonium compound.

9. A method for processing according to claim 8 wherein the amount of the ammonium compound is in the range of from $1\times10^{-3}$ to 0.5 moles/l.

10. A method for processing according to claim 8 wherein the ammonium compound is an ammonium salt.

11. A method for processing according to claim 8 wherein the ammonium compound is ammonium sulfate, ammonium chloride or ammonium sulfite.

12. A method for processing according to claim 8 wherein the replenisher for the stabilization process comprises an aldehyde compound.

* * * * *